United States Patent [19]

Kushida et al.

[11] Patent Number: 5,009,211

[45] Date of Patent: Apr. 23, 1991

[54] FUEL INJECTION CONTROLLING DEVICE FOR TWO-CYCLE ENGINE

[75] Inventors: Kazumitsu Kushida, Tokyo; Osamu Kudou, Saitama; Sumitaka Ogawa, Saitama; Hiroshi Uike, Saitama, all of Japan

[73] Assignee: Honda Giken Kogyo Kabushiki Kaisha, Tokyo, Japan

[21] Appl. No.: 575,616

[22] Filed: Aug. 31, 1990

Related U.S. Application Data

[62] Division of Ser. No. 448,529, Dec. 11, 1989.

[30] Foreign Application Priority Data

Feb. 23, 1989 [JP] Japan ..... 1-41825

[51] Int. Cl.[5] ..... F02D 41/06

[52] U.S. Cl. ..... 123/491; 123/179 L; 123/185 C

[58] Field of Search ..... 123/179 G, 179 L, 185 R, 123/185 C, 185 CA, 491

[56] References Cited

U.S. PATENT DOCUMENTS

| | | | |
|---|---|---|---|
| 3,628,510 | 12/1971 | Moulds et al. | 123/179 L X |
| 4,006,718 | 2/1977 | Konomi | 123/479 |
| 4,114,570 | 9/1978 | Marchak et al. | 123/491 |
| 4,250,849 | 2/1981 | Takase | 123/179 L X |
| 4,366,793 | 1/1983 | Coles | 123/436 |
| 4,366,794 | 1/1983 | Hachiga et al. | 123/198 D |
| 4,653,452 | 3/1987 | Sawada et al. | 123/491 |
| 4,886,029 | 12/1989 | Lill et al. | 123/479 |

FOREIGN PATENT DOCUMENTS

| | | |
|---|---|---|
| 60-45750 | 3/1985 | Japan . |
| 63-208644 | 8/1988 | Japan . |

*Primary Examiner*—Tony M. Argenbright

[57] ABSTRACT

A fuel injection controlling device for a two-cycle engine includes an electronic fuel injection system having a fuel injection quantity determining device for determining a fuel injection amount in response to rotational speed and throttle opening of the engine. At engine start, the controlling device, in response to operation of an engine kick starter, sequentially decreases starting fuel amount as the number of actuations of the kick starter increases. Fuel injection amount is also decreased in response to increasing engine temperature.

4 Claims, 16 Drawing Sheets

204
310
301
ENGINE REVOLUTION (RPM) DETECTOR
302
TARGET (Pbr) MAP
TARGET (Pbr)
303
PRESSURE DIFFERENCE DETECTOR
304
Kp bottom TABLE
305
K pbr CALCULATION
306
THROTTLE APERTURE DETECTOR
307
GIVEN PRESSURE DETECTOR
308
K pir TABLE
309
Ne
θth
Pbr
Pa
Pir
Pbf
Pif
Kpir
Kpbr
Kpif
Kpbf FIG. 6(a)
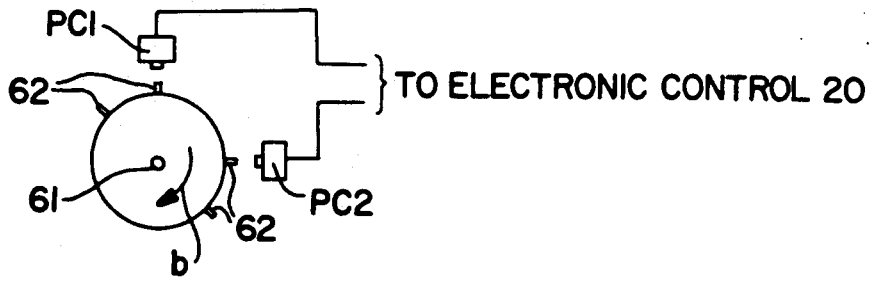
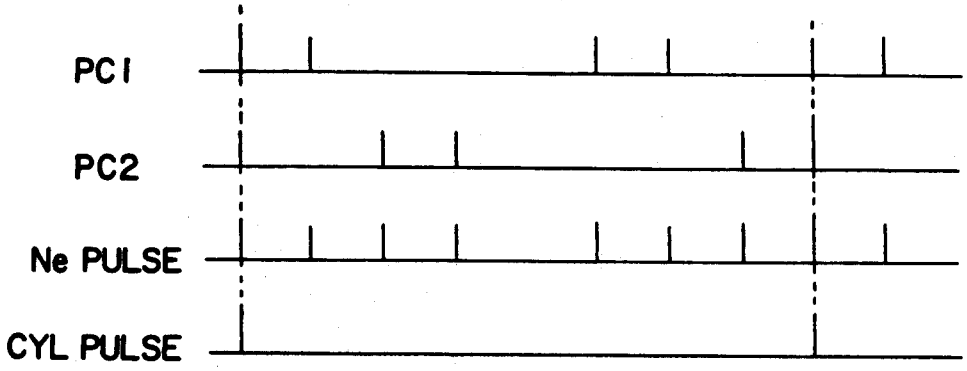
FIG. 6(b)
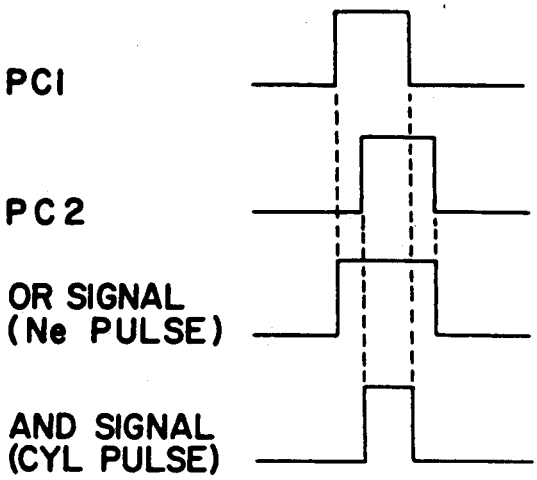
FIG. 7

FIG. 5
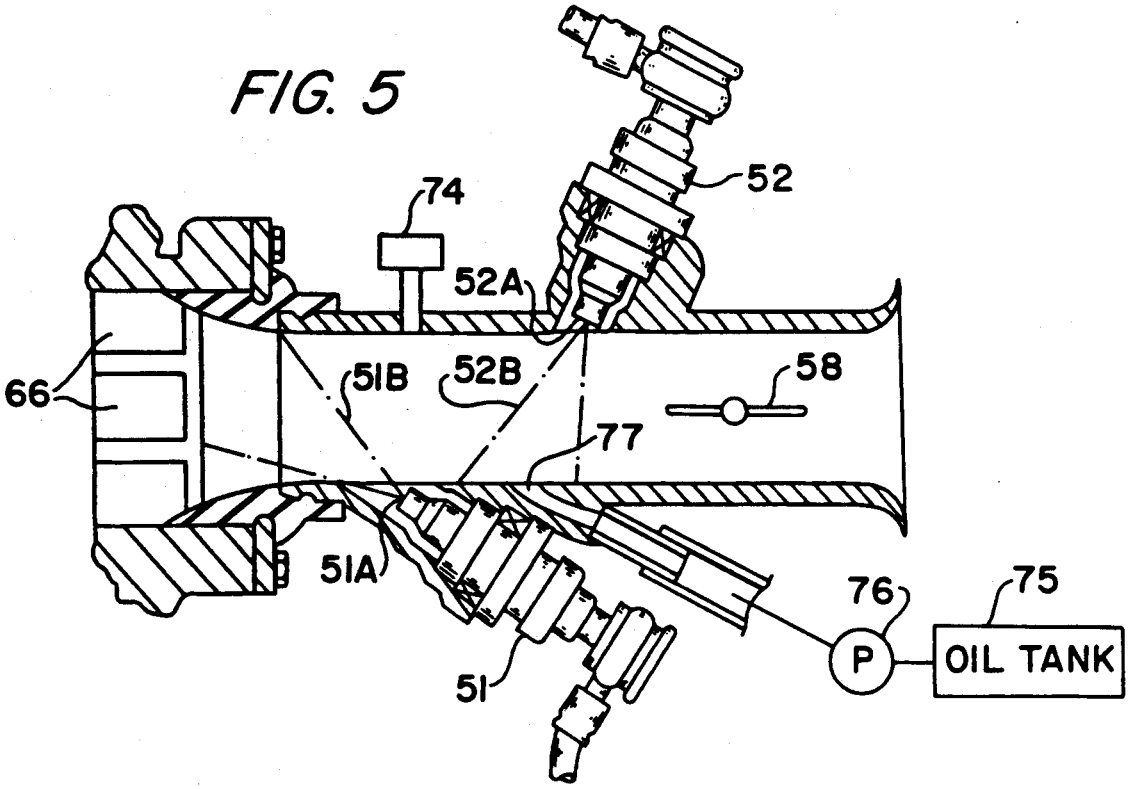
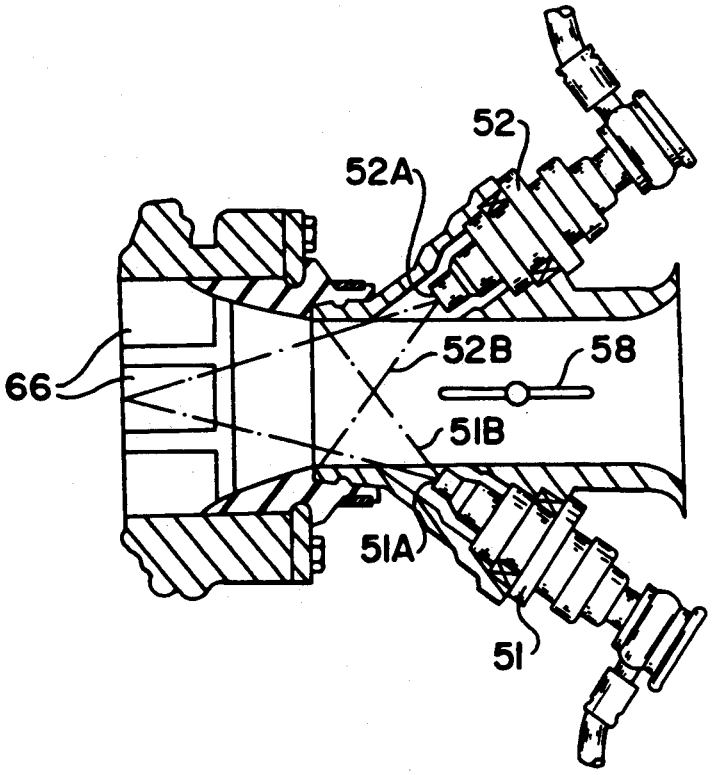
FIG. 22

FUEL INJECTION CONTROLLING DEVICE FOR TWO-CYCLE ENGINE

This application is a divisional of copending application Ser. No. 07/448,529, filed on Dec. 11, 1989.

BACKGROUND OF THE INVENTION

1. Field of the Invention

The present invention relates to a fuel injection controlling device for a two-cycle engine. More particularly, to a fuel injection controlling device for a two-cycle engine which employs an electronic fuel injection system.

2. Description of Background Art

A technique has been proposed for determining when an electronic fuel injection system (Fuel Injection) is to be applied to a two-cycle engine wherein a supply of fuel is responsive to an engine rotational speed Ne and a throttle opening Θth has been proposed. The technique is disclosed, for example, in Japanese Patent Laid-Open No. 59-49337.

The technique described above has the following problems. As illustrated in FIG. 23, variation in throttle opening of a two-cycle engine and variations in amount of fuel to be supplied in response to such variation in throttle opening is set forth. Fuel injection amounts where a carburetor is used as the fuel injection system and where fuel injection is accomplished in response to an engine rotational speed Ne and a throttle opening Θth are shown.

In a two-cycle engine, if the throttle opening Θth is decreased, then the delivery ratio is decreased and consequently the engine will enter a misfire condition.

In a fuel injection system which employs a carburetor, when the throttle opening is small and the delivery ratio is low, fuel is not drafted to a large extent. Accordingly, even if the throttle valve is changed from a low opening condition to a high opening condition, a time lag occurs in the draft amount of fuel. Consequently, an amount of fuel which corresponds to an increase in throttle opening Θth is not immediately supplied. Accordingly, unignited gas in a misfire condition returns to an appropriate air fuel ratio, and transition to a fired condition can be smoothly achieved.

On the other hand, in a fuel injection system which employs an injector which injects fuel in response to Ne and Θth, a fuel injection amount determined in response to Θth is injected immediately. Consequently, fresh air is further supplied to ignited gas in a misfire condition so that the air fuel ratio may be overrich. As a result, the engine may not change from a misfire condition to a fire condition. In particular, the amount of fuel injection is excessively large in a region indicated by oblique lines in FIG. 23.

SUMMARY AND OBJECTS OF THE INVENTION

The present invention has been made to solve the problem described above, and an object of the present invention is to provide a fuel injection controlling device for a two-cycle engine employing an injector by which, even if the engine enters a misfire condition, transition to a fired condition of the engine can be smoothly accomplished.

In order to solve the problem described above, the present invention is characterized in that a misfire condition of an engine is detected, and when the engine is in a misfire condition, the amount of fuel injection is decreased.

Consequently, since the amount of fuel injection is decreased in a misfire condition, even if fuel which is increased in quantity in response to a throttle opening Θth is injected immediately, the air fuel ratio will not become overrich.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 is an enlarged view showing a manner of mounting a main injector and a sub-injector in an intake air pipe connected to an R bank;

FIGS. 6(*a*) and 6(*b*) are views for explaining an Ne pulse and a CLY pulse;

FIG. 7 is a view illustrating a relationship of pulses developed from a first pulser PCI and a second pulser PC2 to an Ne pulse and a CLY pulse;

FIG. 22 is a view showing another example of mounting layout of a main injector and a sub-injector provided in each intake air pipe.

DETAILED DESCRIPTION OF THE PREFERRED EMBODIMENT

Figure 2:
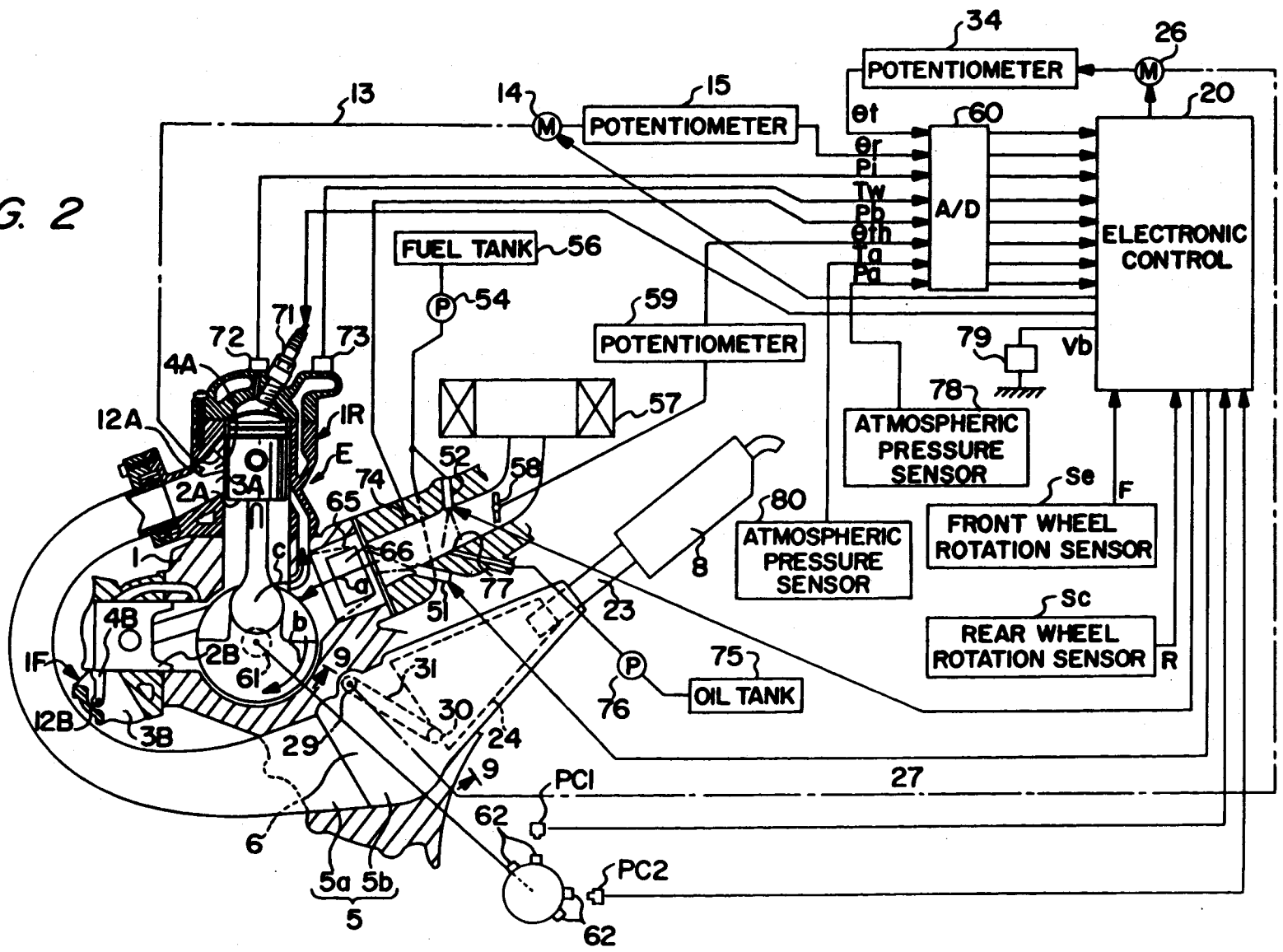
FIG. 2 is a block diagram showing construction of an embodiment of the present invention.
Figure 3:
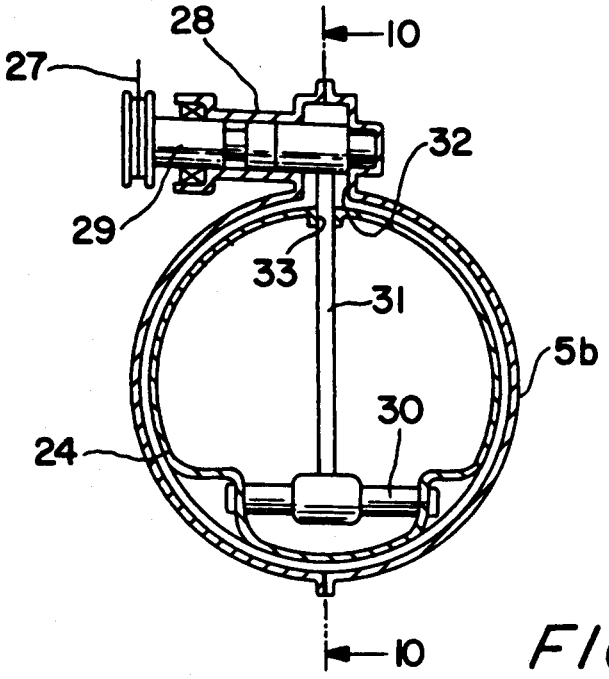
FIG. 3 is a sectional view taken along line 9—9 of FIG. 2.
Figure 4:
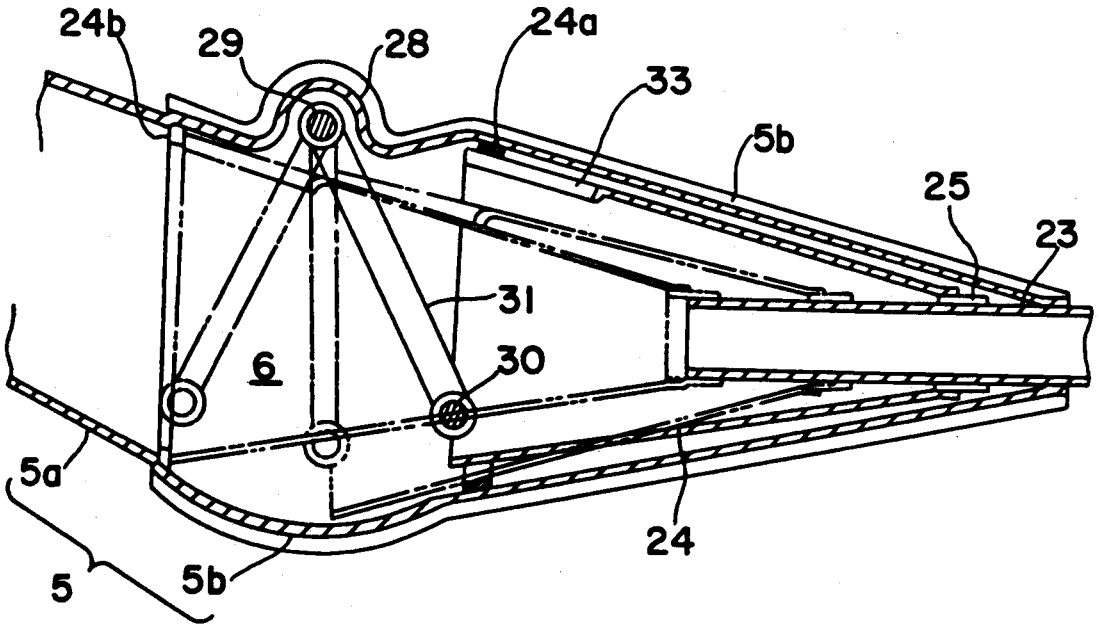
FIG. 4 is a sectional view taken along line 10—10 of FIG. 3.

The present invention being applied to a V-type engine will be described in detail with reference to the following drawings. FIG. 2 is a block diagram showing the construction of an embodiment of the present invention, FIG. 3 a sectional view taken along line 9—9 of FIG. 2, and FIG. 4 is another sectional view taken along line 10—10 of FIG. 3.

In the individual figures, a V-type two-cycle engine E may be supported on a motor-bicycle and includes two cylinders. A front side cylinder 1F, front bank, hereinafter referred to a F bank, and a rear side cylinder IR, rear bank, hereinafter referred to as R bank. It is to be noted that part of the F bank, and an intake air pipe, an exhaust air pipe and so forth connected to the F bank are omitted from the illustration set forth in FIG. 2. Further, ignition timings of the F bank 1F and the R bank IR of the V-type two-cylinder engine E are set with reference to a point in time, for example, after development of a TDC pulse and after rotation of 90 degrees of a crankshaft after development of such pulse.

Exhaust ports 3A and 3B which are opened and closed by pistons 2A and 2B disposed for sliding movement within the cylinders 1 are opened on an inner face of the cylinder 1, and control valves 4A and 4B are disposed at upper portions of the exhaust ports to control the opening and closing timings of the exhaust portions 3A and 3B. Meanwhile, an exhaust pipe 5 connected to the exhaust port 3A is composed of a first pipe portion 5*a* having a downstream end expanded in diameter and a second pipe portion 5*b* of a truncated conical shape having a larger diameter end provided contiguously to the downstream end of the first pipe portion 5*a*, and an expansion chamber 6 is provided in each of the downstream end of the first pipe portion 5*a* and the second pipe portion 5*b*.

A smaller diameter end, that is, the downstream end of the second pipe portion 5*b* of the exhaust pipe 5 has a communicating pipe 23 fitted on and secured thereto, and an outer end of the communicating pipe 23 is connected to a muffler 8. A reflecting pipe 24 of a truncated conical shape as a control operating means for reflecting a positive pressure wave caused by exhaust gas toward the exhaust port 3A is disposed in the second pipe portion 5*b*. The reflecting pipe 24 is disposed in the second pipe portion 5*b* with a larger diameter end thereof directed to the first pipe portion 5*a* side. A collar 25, as illustrated in FIG. 4, is fitted on a small diameter end of the reflecting pipe 24 for sliding movement on an outer periphery of the communicating pipe 23.

A servomotor 26 as a driving source which is controlled in operation by an electronic controlling device 20 is connected to the reflecting pipe 24 by way of a motion transmitting mechanism 27. In particular, a driving shaft 29 is supported for rotation on a bearing portion 28 provided on an outer face of an upper portion of the larger diameter portion of the second pipe portion 5*b*, and the driving shaft 29 and a driven shaft 30 provided at the larger diameter end of the reflecting pipe 24 are interconnected by way of a connecting rod 31 while the motion transmitting mechanism 27 is connected to the driving shaft 29.

Further, an elongated hole 32 extending in the direction of a generating line and a recess 33 are provided at upper portions of the larger diameter ends of the second pipe portion 5*b* and the reflecting pipe 24 in order to permit rocking motion of the connecting rod 31. According to such construction, as the driving shaft 29 is driven, the connecting rod 31 is rocked so that the reflecting pipe 24 is slidably moved along the communicating pipe 23.

It is to be noted that, as shown in FIG. 4, annular resilient members 24*a* and 24*b* for restricting the position of the reflecting pipe 24 when the reflecting pipe 24 is moved to its rearmost end position and frontmost position are disposed in the exhaust pipe 5.

A potentiometer 34 is provided for the servomotor 26, and the position of the reflecting pipe 24, that is, the amount of rotation of the driving shaft 29 is detected by the potentiometer 34. A detection amount $\Theta t$ of the potentiometer 34 is inputted to the electronic controlling device 20 by way of an analog to digital converter 60.

It is to be noted that a reflecting pipe disposed in the exhaust pipe (not shown) connected to the exhaust port 3B may be driven by the servomotor 26 or by another servomotor.

The control valves 4A and 4B provided for the exhaust ports 3A and 3B are securely mounted on driving shafts 12A and 12B disposed for rotation in the cylinder 1. The driving shaft 12A is connected to a servomotor 13 serving as a driving source by way of a motion transmitting mechanism 13 which is composed of a pulley, a motion transmitting belt and so forth. Meanwhile, a potentiometer 15 for detecting the amount of operation of the servomotor 14, that is, the opening of the control valve 4A is provided for the servomotor 14, and a detection amount $\Theta r$ of the potentiometer 15 is also inputted to the electronic controlling device 20 by way of the analog to digital converter 60. It is to be noted that the driving shaft 12B may be driven by the servomotor 14 or by another servomotor.

A main injector 51 and a sub-injector 52 is disposed in an intake air pipe connected to the R bank 1R on the downstream side of an air flow of a throttle valve 58 of the two-cycle engine E. In the case of the present example, the fuel injection amount of the main injector 51 per unit energization time is set to a value greater than that of the sub-injector 52.

Two types of injectors, similar to injectors 51 and 52, are disposed in an intake air pipe connected to the F bank IF on the downstream side of an air flow of the throttle valve 58.

The main injector 51 is disposed in such a manner as to inject fuel toward a valve body 66 of a reed valve while the sub-injector 52 is disposed in such a manner as to inject fuel toward an engine oil (hereinafter referred to only as oil) supply pipe 77 which is opened on the downstream side of the throttle valve 58.

An enlarged view of mounting portions of the main and sub-injectors 51 and 52 in the intake air pipe connected to the R bank IR is shown in FIG. 5. Referring to FIG. 5, 51A and 52A denote fuel injection ports, and 51B and 52B denote a range of fuel injections.

The main and sub-injectors 51 and 52 are connected to a fuel tank 56 by way of a fuel pump 54, and the fuel injection times (energization times) of the injectors are controlled by the electronic controlling device 20.

Meanwhile, lubricating oil is supplied by an oil pump 76 to the oil supply port 77 from an oil tank 75.

Since the individual injectors are disposed in such a manner as described above, when it is necessary to supply a large quantity of fuel in a high engine rotational speed region, if fuel injection is carried out using the main injector 51, then fuel can be supplied efficiently into a crankcase by way of the reed valve.

On the other hand, when a large amount of fuel supply is not necessitated in a low engine rotational speed region, if fuel injection is carried out using the sub-injector 52, then oil discharged from the oil supply port 77 can be supplied efficiently into the crankcase by way of the reed valve in such a manner that it may be washed away by injected fuel.

A potentiometer 59 for detecting an opening Θth of the throttle valve 58 is provided for the throttle valve 58, and also a detection amount Θth thereof is inputted to the electronic controlling device 20 by way of the analog to digital converter 60.

A plurality of pawls 62 are formed on a crankshaft 61 of the two-cycle engine. The pawls 62 are detected by a first pulser PCI and a second pulser PC2. Output signals of the first and second pulsers PCI and PC2 are inputted to the electronic controlling device 20.

Further, output signals of a rotational speed detecting sensor Se for a front wheel and another rotational speed detecting sensor Sc for a rear wheel of the motor-bicycle, a front wheel rotational speed F and a rear wheel rotational speed R, are inputted to the electronic controlling device 20.

Also, a pressure sensor 72 for detecting a combustion chamber internal pressure Pi, hereinafter referred to an internal pressure, a cooling water temperature sensor 73 for detecting an engine cooling water temperature Tw, an intake air pipe internal negative pressure sensor 74 for detecting an intake air pipe internal pressure Pb, an atmospheric pressure sensor 78 for detecting an atmospheric pressure Pa and an atmospheric temperature sensor 80 for detecting an atmospheric temperature Ta are connected to the electronic controlling device 20 by way of the analog to 1S digital converter 60. An internal pressure sensor and an intake air pipe internal negative pressure sensor are provided also on the F bank 1F side.

It is to be noted that, while the internal pressure sensor 72 is provided near an ignition plug 71 in FIG. 2, it may, in the alternative, be provided near the exhaust port.

The electronic controlling device 20 is a microcomputer including a CPU, a ROM, a RAM, input/output interfaces, buses connecting them and so forth. The electronic controlling device 20 controls energization timings and energization times of the main and sub-injectors as well as the openings of the control valves 4A and 4B and the positions of the reflecting pipes as hereinafter described.

It is to be noted that an air cleaner 57, a reed valve housing 65, a valve body 66 of the reed valve and a battery 79 are also provided in operative relationship relative to each other.

Meanwhile, an arrow "b" indicates a direction of rotation of the crankshaft, and arrows "a" and "c" indicate directions of flow of the fuel air mixture.

Subsequently, operation of the embodiment of the present invention will be described. Basically, operation of the embodiment is roughly separated into operation executed by a main routine and operation executed by an interrupt routine by an Ne pulse which will hereinafter be described.

An Ne pulse and a cylinder pulse, or TDC pulse, hereinafter referred to as CYL pulse, which are necessary for a description of the operation of the embodiment of the present invention will be described briefly.

FIGS. 6(*a*) and 6(*b*) are views for explaining an Ne pulse and a CYL pulse. FIG. 6(*a*) is a schematic view of the pawls 62 mounted in a concentrical relationship with the crankshaft 61 as well as the first pulser PCI and the second pulser PC2. FIG. 6(*b*) is a timing chart of pulses developed from the first and second pulsers PCI and PC2 as well as Ne pulses and CYL pulses when the crankshaft 61 is rotated in the direction of the arrow b as illustrated in FIG. 6(*a*).

As illustrated in FIG. 6(*a*) and 6(*b*), an Ne pulse and a CYL pulse are an OR signal and an AND signal of pulses developed from the first and second pulsers PC1 and PC2.

Here, since there is a little time lag between pulses developed from the first and second pulsers PC1 and PC2 as shown in detail in FIG. 7, an Ne signal which is an OR signal is developed earlier than a CYL pulse which is an AND signal. It is to be noted that, when an Ne pulse and a CYL pulse are developed at the same time, a process which uses an Ne pulse is preferentially executed.

Figure 19:
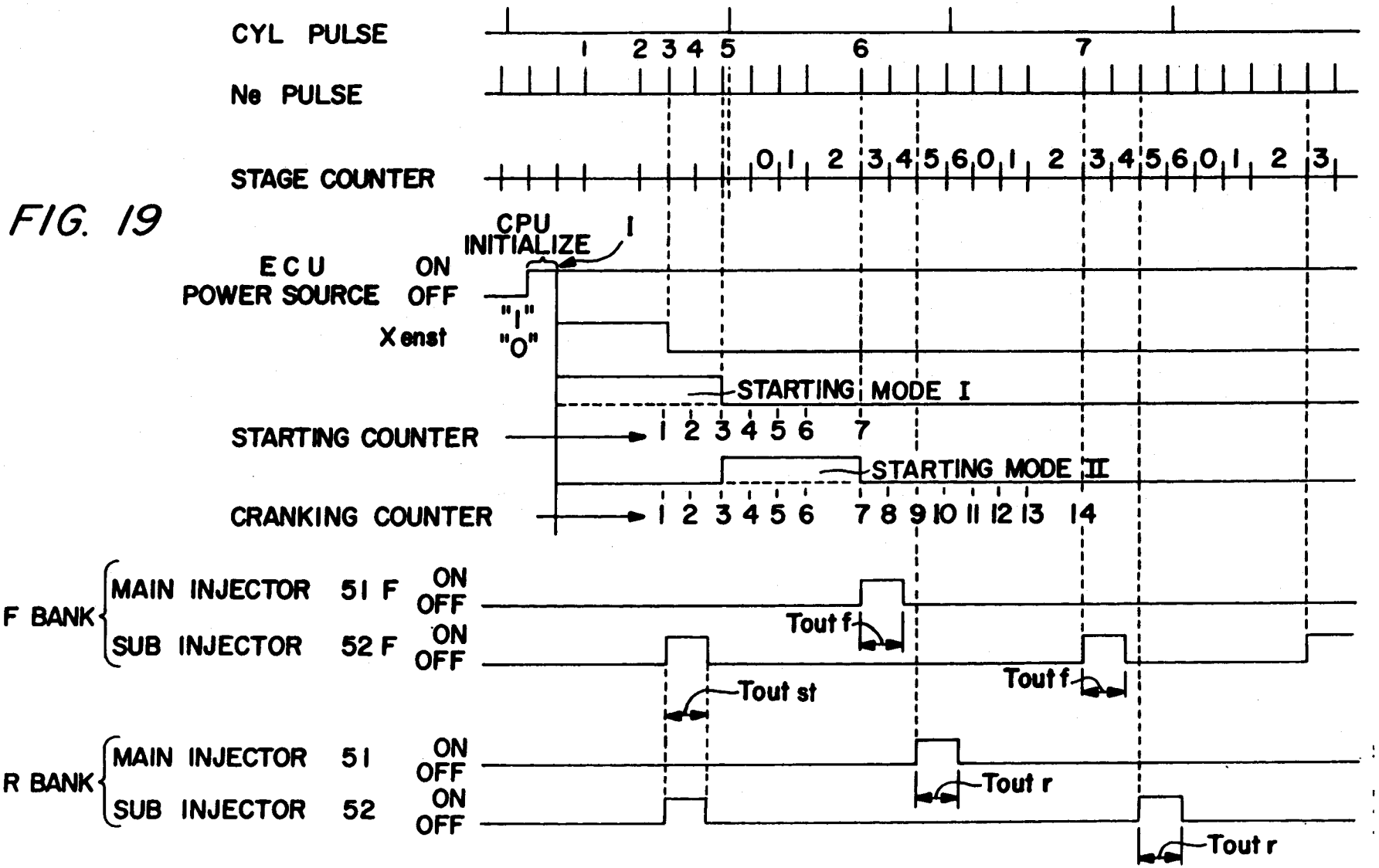
FIG. 19 is a time chart illustrating an example of the operation of the embodiment of the present invention.

Meanwhile, each time an Ne pulse is developed, a stage counter, as illustrated in FIG. 19, is incremented, and the count value thereof is reset to zero each time a CYL pulse is developed or each time a predetermined number of Ne pulses are developed after development of a CYL pulse. In particular, in the present example, the number of stages, stage number, is 0 to 6.

Figure 8:
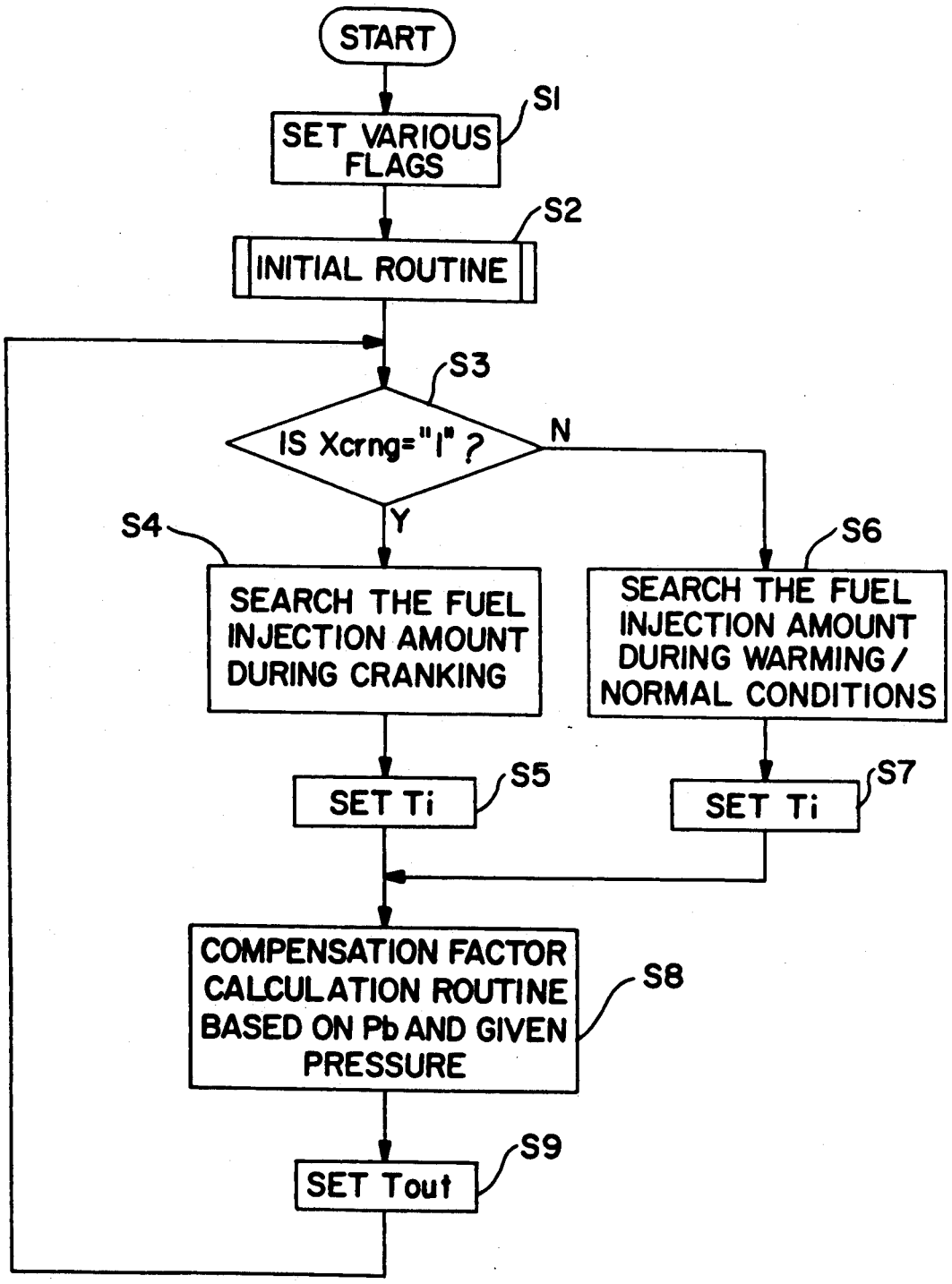
FIG. 8 is a flow chart showing a main routine of operation of the embodiment of the present invention.
Figure 9:
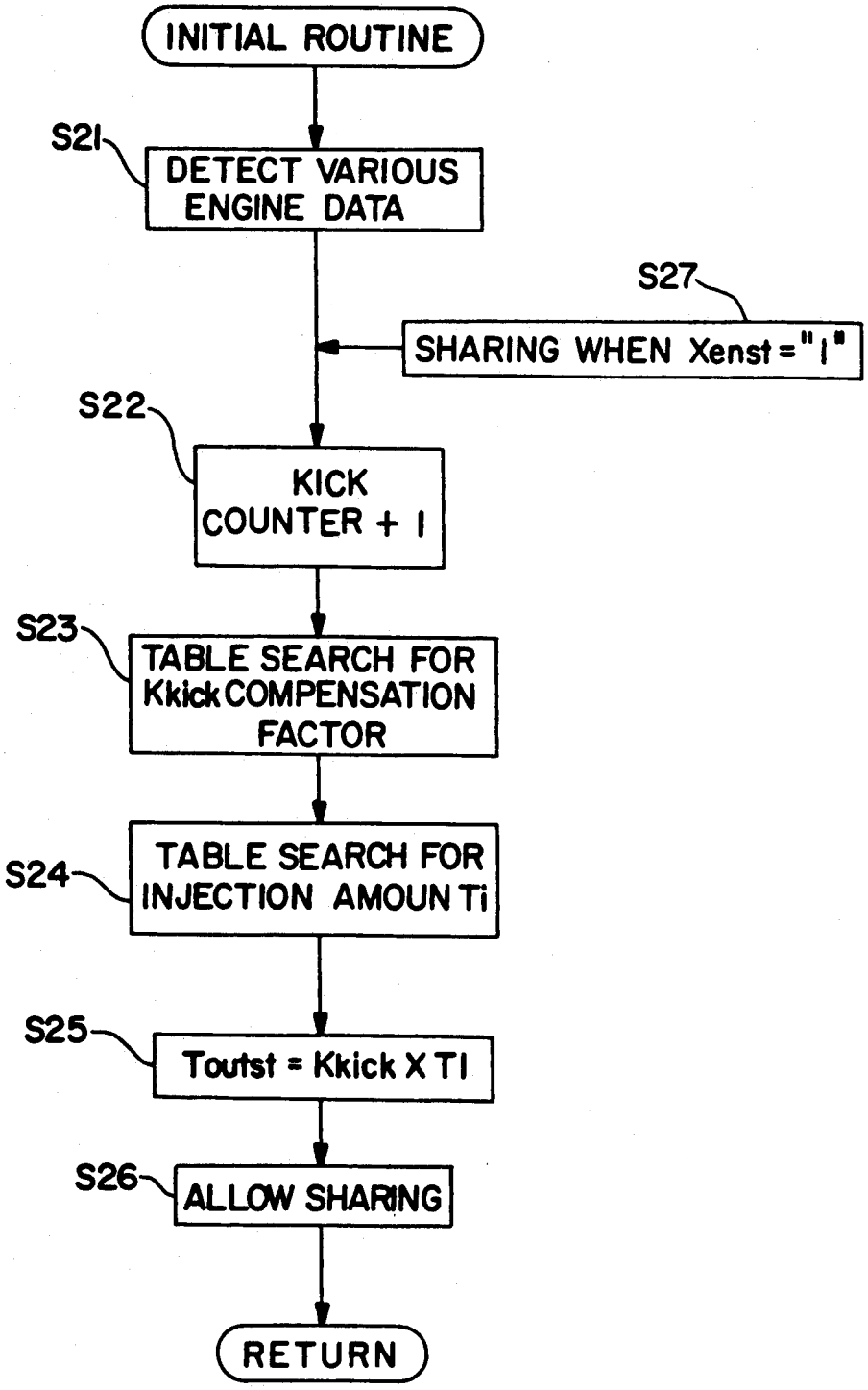
FIG. 9 is a flow chart showing an initial routine.

FIG. 8 is a flow chart showing a main routine of operation of the embodiment of the present invention which is executed by the electronic controlling device 20. At first at step S1, an engine stop flag Xenst, a cranking flag Xcrng, an Ne flag Neflag and a rear bank flag Xrbank are all set to "1". Further, the count value of a kick counter which will be hereinafter described in connection with step S22 of FIG. 9 is reset to 0. At step S2, an initial routine is executed.

FIG. 9 is a flow chart showing details of the initial routine. At the first step S21, an engine condition, that is, various engine parameters, an atmospheric temperature Ta, a cooling water temperature Tw, an atmospheric pressure Pa, an intake air pipe internal negative pressure Pb, an intake air pipe internal negative pressures Pbr and/or Pbf on the R bank side and/or the F bank side, a throttle opening Θth and a battery voltage Vb are inputted from the various means shown in FIG. 2.

At step S22, a value 1 is added to the kick counter. At step S23, a correction coefficient, Kkick, is read out from a kick counter table.

Figure 10:
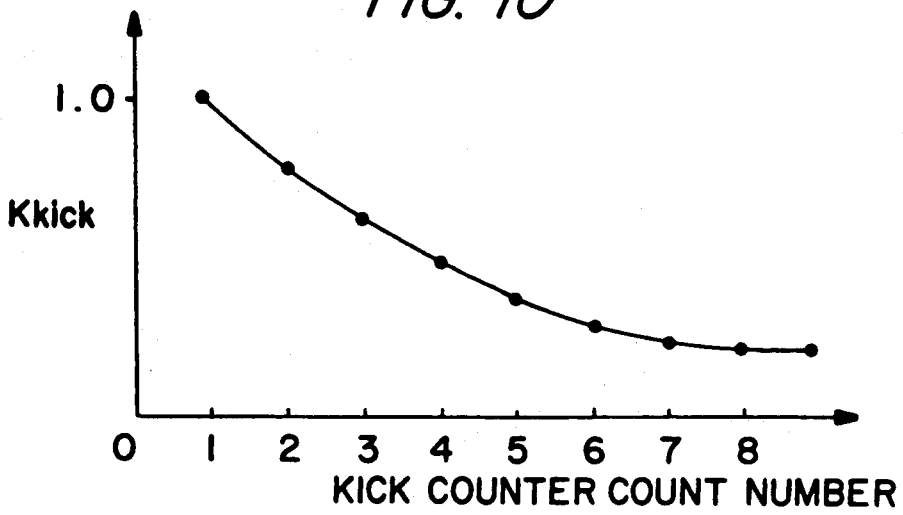
FIG. 10 is a view showing a kick counter table.

FIG. 10 is a view showing details of the kick counter table. As shown in FIG. 10, the correction coefficient Kkick is set such that it is equal to 1.0 when the count value of the kick counter is equal to 1, but it is decreased as the count value increases.

At step S24, a fuel injection amount Ti for simultaneous injection wherein fuel injection to the F bank IF and the R bank IR is carried out simultaneously is calculated by a known technique using the various engine parameters detected at step S21.

It is to be noted that a fuel injection amount Ti calculated or retrieved at step S24 or at step S4 or S6 which will be hereinafter described is an energization time of a solenoid of a main injector or a sub-injector. Whether the main injectors or the sub-injectors are used to carry out fuel injection is determined, for example, depending upon an amount of fuel to be injected.

At step S25, the simultaneous injection amount Ti obtained at step S24 is corrected using a first expression:

$$Toust = Kkick \times Ti \quad (1)$$

At step S26, an interruption which is executed when a requirement at step S27 is fulfilled. In particular, when Xenst changes from "0" to "1" as shown at step S27, the sequence is interrupted at step S22, but such interruption is executed only after the processing at step S26 is completed. In short, after closing of an ignition switch, the processes from steps S21 to S25 are executed without fail, and the interruption shown at step S27 is allowed only after the process at step S26 is completed. Xenst changes from "0" to "1" when the engine rotational speed becomes lower than a predetermined rotational speed after execution of simultaneous injection, that is, when firing does not take place after a kicking operation, as hereinafter described in connection with FIG. 18.

After the interruption of step S27 takes place, the count value of the kick counter is incremented by one, step S22, Kkick is retrieved, step S23, a simultaneous injection amount Ti is retrieved, step S24, and then the simultaneous injection amount is corrected using the first expression. As illustrated in FIG. 10, since the value of Kkick decreases as the count value of the kick counter increases, the simultaneous injection amount decreases each time the interruption takes place.

In the case of a motor-bicycle wherein starting is carried out by using a kick starter device, if a kicking operation is carried out, then fuel injection of a predetermined amount is performed, but in case firing does not take place upon such kicking, if a kicking operation is carried out again and consequently fuel injection of the same amount is performed again, then the fuel air mixture will become overrich due to an influence of unignited gas within a combustion chamber so that the starting performance may deteriorate.

However, if the simultaneous injection amount is corrected using such a correction coefficient Kkick as shown in FIG. 10, then the possibility as described above is eliminated. Now, the sequence returns to the main routine after the process at step S26.

Referring back to FIG. 8 at step S3, it is judged whether or not Xcrng is equal to "1". The Xcrng designates whether or not the vehicle is in a cranking condition as hereinafter described in connection with step S121 of FIG. 18(*b*). Since Xcrng is set to "1" at step S1 upon initialization described hereinabove, the sequence advances to step S4.

Figure 11:
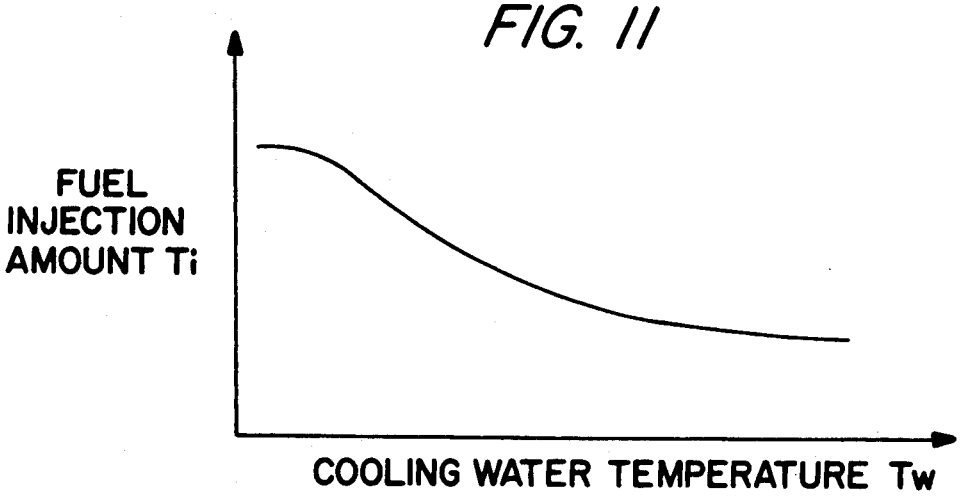
FIG. 11 is a view showing a cranking table.

At step S4, a fuel injection amount Ti for cranking, in a condition for about two rotations of the crankshaft till warming up after completion of the starting, is retrieved from a cranking table using the cooling water temperature Tw. The cranking table is shown in FIG. 11. At step S5, Ti retrieved at step S4 is stored into a predetermined register.

At step S8, a correction coefficient calculating routine depending upon the intake air pipe internal negative pressure Pb or the internal pressure Pi is executed. The routine is shown in FIG. 12.

Figure 12:
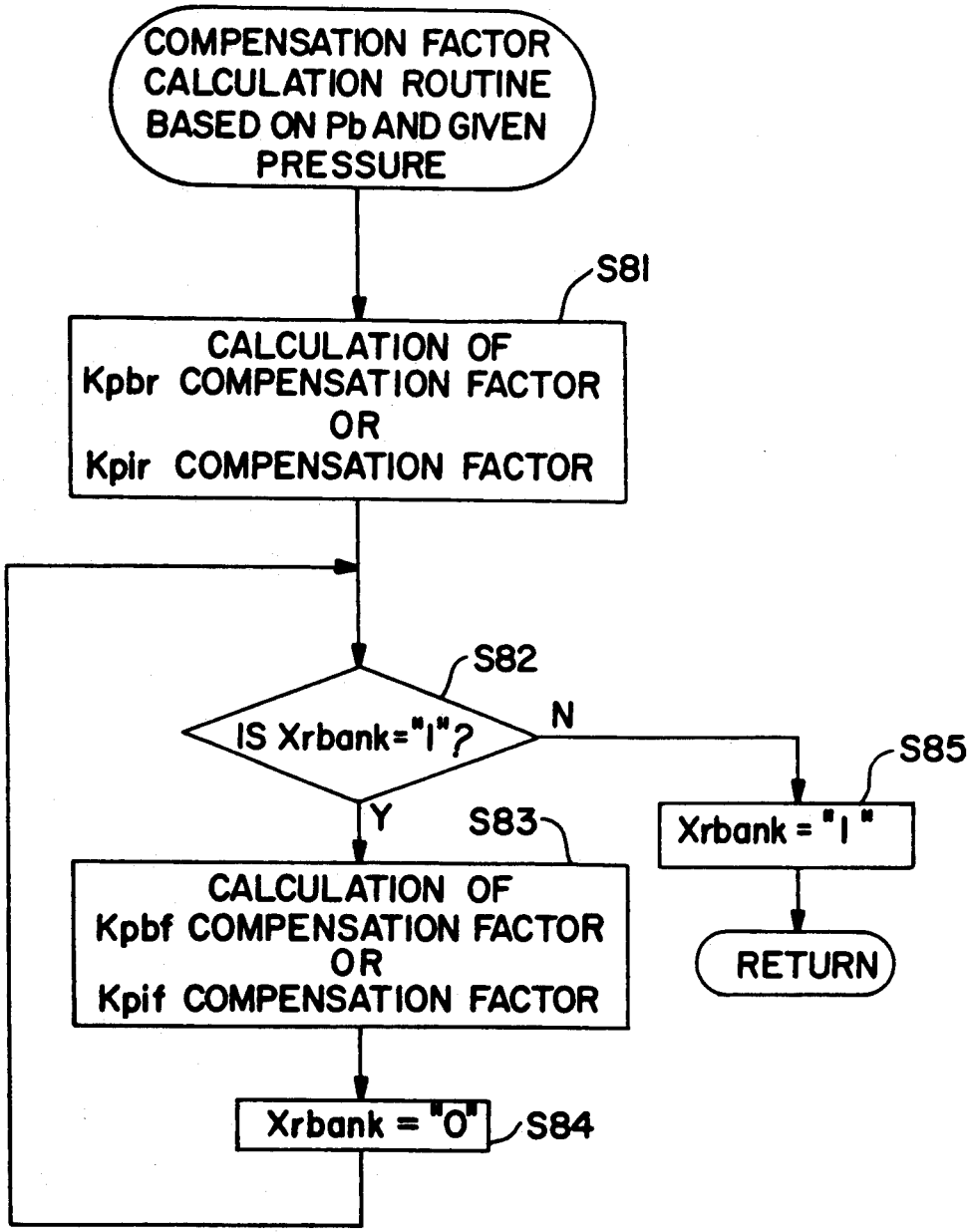
FIG. 12 is a flow chart showing details of a process shown at step S8 of FIG. 8.

Referring to FIG. 12, at first at step S81, a correction coefficient Kpbr, which depends upon the intake air pipe internal negative pressure Pb, hereinafter referred to as Pbr on the R bank side or a correction coefficient Kpir depending upon the internal pressure Pi, hereinafter referred to as Pir, on the R bank side is calculated. The calculating subroutine is shown in FIG. 13.

Figure 13:
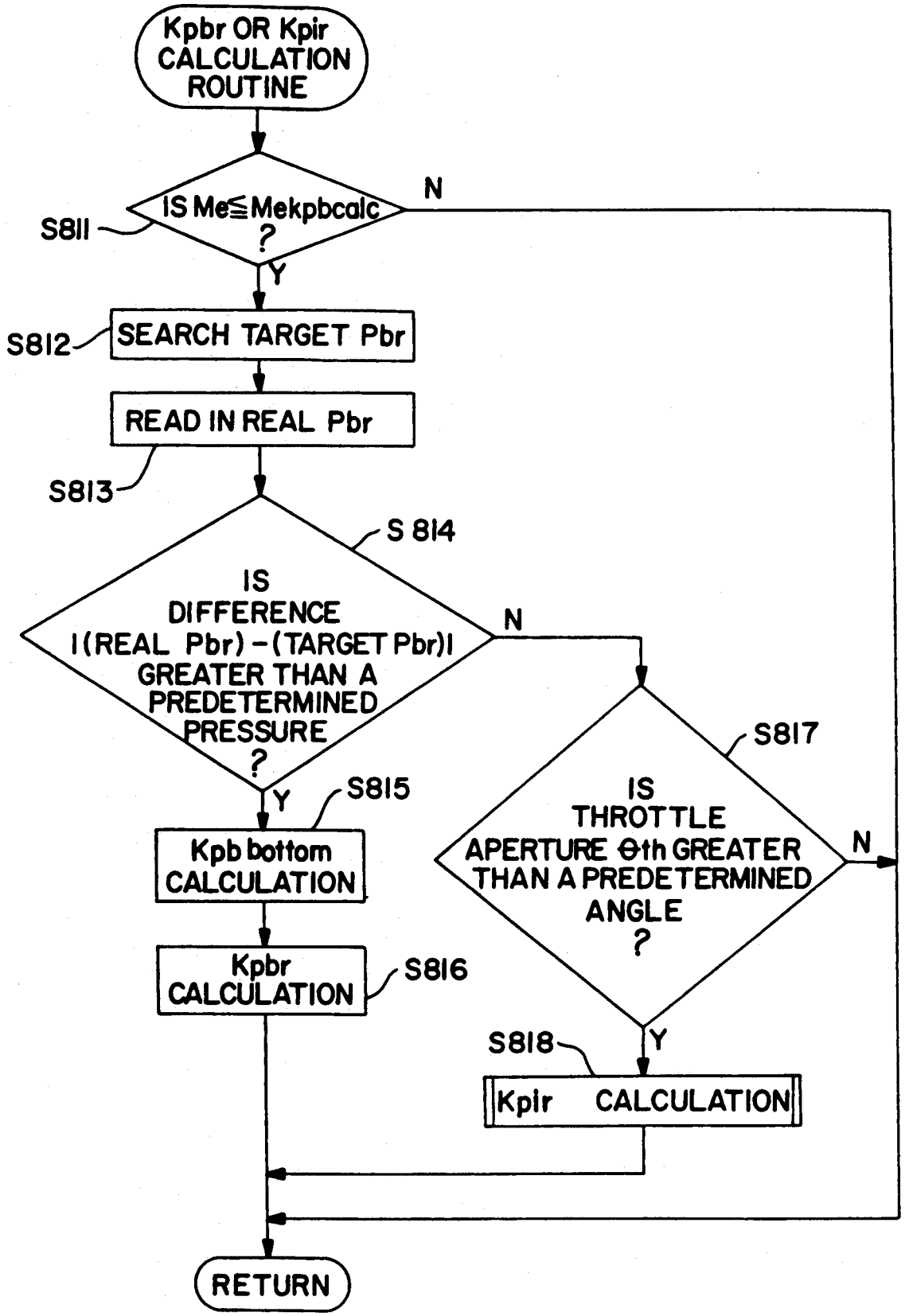
FIG. 13 is a flow chart showing details of a process shown at step S8l of FIG. 12.

Referring to FIG. 13, at first at step S811, it is judged whether or not an interval Me, reciprocal number to the engine rotational speed Ne, after which an Ne pulse which defines a predetermined stage is developed is equal to or smaller than Mekpbcalc, that is, whether or not the engine rotational speed Ne is equal to or higher than a predetermined rotational speed, for example, 6,000 rpm.

In case Me is greater than Mekpbcalc, the engine rotational speed is lower, then the subroutine comes to an end.

If Me is equal to or smaller than Mekpbcalc, the engine rotational speed is higher, then an intake air pipe internal negative pressure, hereinafter referred to as target Pbr, for a fired condition of the R bank is retrieved, at step S812, form a target Pbr map using the engine rotational speed Ne and the throttle opening Θth as parameters. In the target Pbr map, various values of the target Pbr are set using Ne and Θth as parameters. The target Pbr map can be constructed depending upon an experiment in which the R bank is used.

At step S813, an actual intake air pipe internal negative pressure Pbr on the R bank side is read in.

At step S814, it is judged whether or not the difference Δ of the target Pbr from the actual Pbr is greater than a predetermined pressure, for example, 7.5 mmHg.

In case Δ is greater than the predetermined pressure, Kpb bottom is calculated from a Kpb bottom table at step S815. In the Kpb bottom table, various values of Kpb bottom are set using the engine rotational speed Ne and the throttle opening Θth as parameters.

Figure 14:
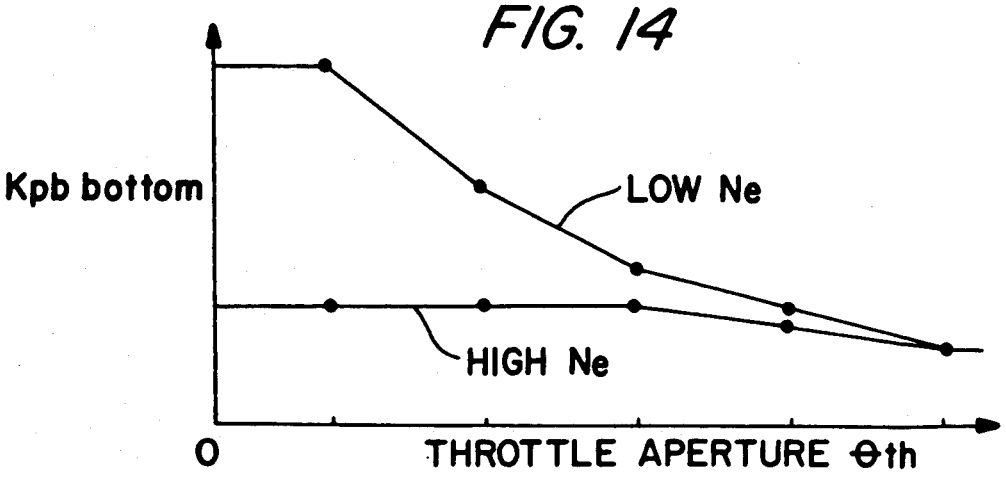
FIG. 14 is a view showing a Kpb bottom table.

The Kpb bottom table is shown in FIG. 14. Referring to FIG. 14, if the engine rotational speed Ne is higher than a predetermined rotational speed, then data indicating "high Ne" are selected, but if the engine rotational speed Ne is equal to or lower than the predetermined rotational speed, then data indicating "low Ne" are selected. It is to be noted that, in the table, five data of Kpb bottom are set for each throttle opening Θth, and although calculation of Kpb bottom is executed after reading out of the engine rotational speed Ne and the throttle opening Θth is not a value corresponding to the Kpb bottom data set in the Kpb bottom table. Kpb bottom is calculated by an interpolation calculation.

Figure 15:
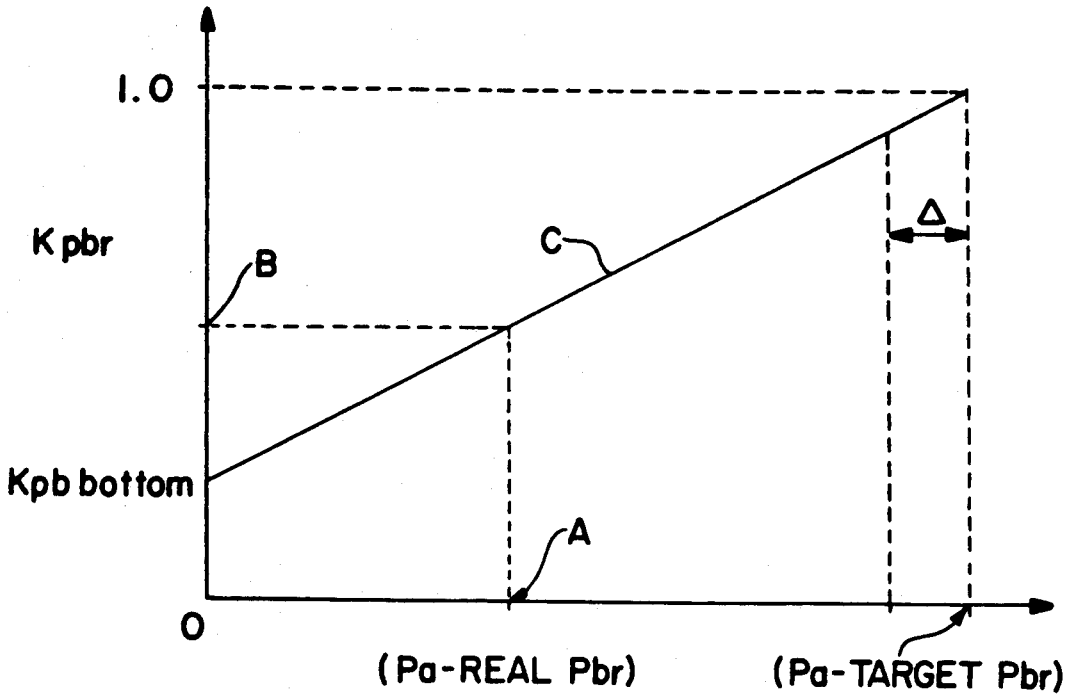
FIG. 15 is a view illustrating a technique of calculating a correction coefficient Kpbr.

At step S816, a correction coefficient Kpbr is calculated. A technique of calculation of a correction coefficient Kpbr will be described using FIG. 15. Referring to FIG. 15, the axis of abscissa indicates a pressure value obtained by subtraction of the intake air pipe internal negative pressure Pb from the atmospheric pressure Pa while the axis of ordinate indicates a correction coefficient Kpbr.

At first, a point of Kpbr = 1.0 is set with respect to a pressure value obtained by subtraction of the target Pbr from the atmospheric pressure Pa, and at the same time, a point corresponding to the value of Kpb bottom calculated at step S815 described hereinabove is set with respect to the pressure value equal to 0.

Then, a straight line C which passes the two points is determined, and a point, the point denoted at B in FIG. 15, on the Kpbr axis corresponding to a difference, the point denoted at A in FIG. 15, obtained by subtraction of the actual Pbr from the atmospheric pressure Pa is calculated by straight line interpolation on the straight line C. The value of the point B makes it possible to calculate a value of Kpbr.

Since the target Pbr is a Pbr in a fired condition, it is smaller than a Pbr value upon misfiring, and the value of the intake air pipe internal negative pressure actually detected is a value far different from the target Pbr, it is presumed that a misfire takes place in the R bank, step S814. Accordingly, in this instance, a correction coefficient Kpbr smaller than 1 is set, and the fuel injection amount Ti is multiplied by the correction coefficient Kpbr to decrease the fuel injection amount as hereinafter described in connection with step S9 of FIG. 8.

It is to be noted that the judgment at step S814 described hereinabove is provided to pressure, in case the difference of atmospheric pressure Pa - intake air pipe internal negative pressure Pbr from atmospheric pressure Pa - target Pbr remains within the range indicated by reference character Δ as shown in FIG. 15, that no misfire takes place in the R bank and to inhibit calculation of a correction coefficient Kpbr, or to set 1 to the correction coefficient Kpbr. After completion of the process at step S816, the sequence comes to an end.

As is apparent from the foregoing description, calculation of Kpbr with which correction of a fuel injection amount is to be executed is carried out when the engine rotational speed Ne is higher than the predetermined rotational speed, for example, 6,000 rpm, step S811, and the engine is in a misfire condition, step S814.

Where an exhaust system of a two-cycle engine is set such that a high delivery ratio may be attained at a high engine rotational speed Ne, for example, higher than 6,000 rpm, generally the delivery ratio becomes low when the throttle opening Θth is small and a misfire takes place. In the case where the throttle opening Θth is increased thereafter, if it is tried, for example, to execute control of the fuel injection amount only with the throttle opening Θth and/or the engine rotational speed Ne, only the fuel injection amount is increased in spite of a low delivery ratio condition and the air fuel mixture becomes overrich. Consequently, transition from the misfire condition to a fired condition cannot be smoothly achieved.

On the contrary, in case when a misfire condition of the engine is detected and the fuel injection amount is decreased upon restoration from the misfire condition as in the present embodiment, even if fuel is determined in accordance with the throttle opening Θth and is injected immediately, the air fuel mixture will not become overrich, and transition from the misfire condition to a fired condition can be smoothly achieved.

Now, if it is judged at step S814 described hereinabove that the difference Δ obtained by subtraction of the target Pbr from the actual Pbr is not greater than the predetermined pressure mentioned hereinabove, then at step S817, it is judged whether or not the throttle opening Θth is equal to or greater than a predetermined opening, for example, 50 %. In the case where the throttle opening Θth is not equal to or greater than the predetermined opening, then the sequence comes to an end.

If the throttle opening Θth is equal to or greater than the predetermined opening, then a correction coefficient Kpir is calculated at step S818. The subroutine of the step S81 is shown in FIG. 16.

Figure 16:
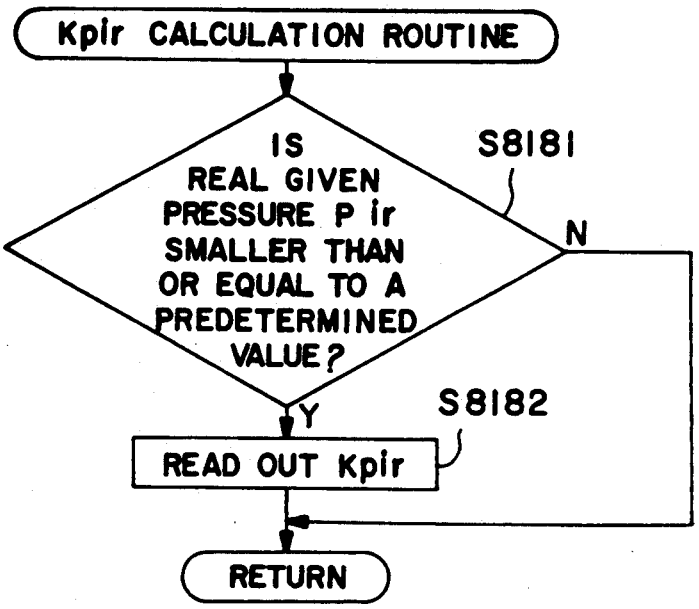
FIG. 16 is a flow chart showing details of a process shown at step S8l8 of FIG. 13.

Referring to FIG. 16, at step S8181, it is judged whether or not the actual internal pressure Pir of the R bank is equal to or lower than a predetermined pressure. If the actual internal pressure Pir is higher than the predetermined pressure, then the sequence comes to an end.

Figure 17:
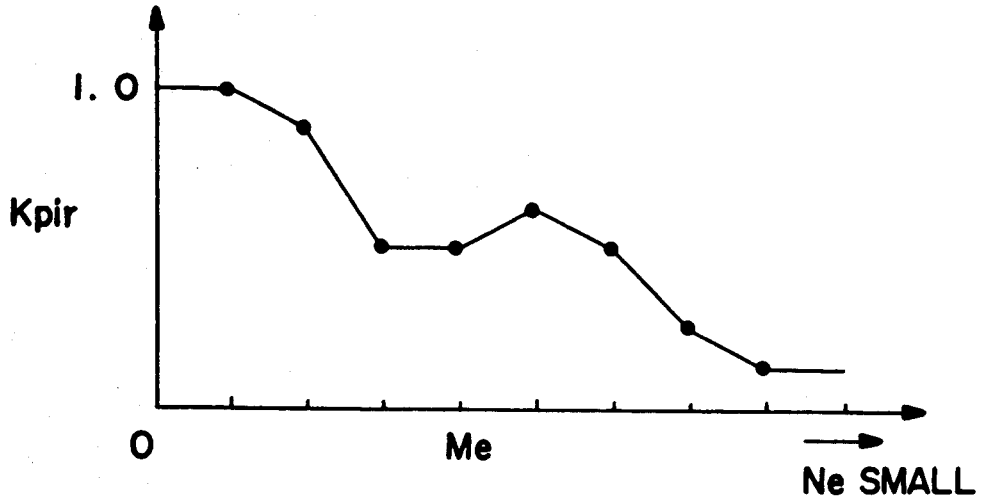
FIG. 17 is a view showing a Kpir table.

In the case where the actual internal pressure Pir of the R bank is equal to or lower than the predetermined pressure, it is judged that the R bank is in a misfire condition, and at step S8182, a correction coefficient Kpir is read out in response to Me from a Kpir table. The Kpir table is shown in FIG. 17. Referring to FIG. 17, while values of Kpir are set individually for 8 values of Me, in the case where a value of Kpir to be read out corresponding to Me is not set, Kpir is determined by an interpolation calculation. The sequence comes to an end after completion of the process at step S8182. Referring back to FIG. 13, the sequence comes to an end after completion of the process at step S818.

Now, the correction coefficient Kpir calculated at step S818 described hereinabove is multiplied by the fuel injection amount Ti to decrease the fuel injection amount as hereinafter described in connection with step S9 of FIG. 8. The significance of a decrease in the fuel injection amount with a correction coefficient Kpir is described as follows.

In particular, a correction coefficient Kpir is calculated when the difference between the actual intake air pipe internal negative pressure Pbr and the target Pbr is within the predetermined pressure difference, step S814 in FIG. 13, and the throttle opening Θthe is a high opening condition, step S817 in FIG. 13, and the actual internal pressure Pir is equal to or lower than the predetermined value, step S818 in FIG. 16.

In the case where the difference between the actual intake air pipe internal negative pressure Pbr and the target Pbr is within the predetermined pressure difference Δ, calculation of a correction coefficient Kpbr, step S817 in FIG. 13, and hence correction with such correction coefficient Kpbr will not be executed. However, in the case where the throttle opening Θth is in a high opening condition, even if a misfire takes place in a cylinder, such misfire may not be judged because the value of atmospheric pressure Pa - target Pbr shown in FIG. 15 approaches the origin. In particular, if it is assumed that the difference in pressure from the origin of FIG. 15 to atmospheric pressure Pa - target Pbr has been reduced to Δ, then even if a misfire has taken place, no correction of a fuel injection amount is executed. Further, in other words, in the case where the throttle opening Θth is in a high opening condition since the value of the target Pbr presents a value proximate the atmospheric pressure, even if a misfire takes place, the value of atmospheric pressure Pa - target Pbr will come within the range of Δ, and correction of a fuel injection amount will not be executed.

Accordingly, even if the difference between the target Pbr and the actual intake air pipe internal negative pressure Pbr is within the predetermined pressure difference Δ, when the throttle valve Θth is in a high opening condition and the actual internal pressure Pir is equal to or lower than the predetermined value, it is judged that the cylinder is in a misfire condition. Consequently, a correction coefficient Kpir smaller than 1 is calculated and a fuel injection amount is calculated using the Kpir. As a result, the fuel air mixture will not become overrich after the misfire similarly as in the correction depending upon the correction coefficient Kpbr, and transition to a fired condition can be readily achieved.

It is to be noted that, in the case where the difference Δ obtained by subtraction of the target Pbr from the actual Pbr is equal to or lower than the predetermined pressure, step S814, and the throttle opening Θth is equal to or higher than the predetermined opening, step S817, instead of execution of correction using Kpir, the process at step S814 may be executed again after the predetermined pressure, for example, 7.5 mmHg, used for comparison at step S814 is decreased.

Referring back to FIG. 12, at step S82, it is judged whether or not Xrbank is equal to "1". Upon initialization, Xrbank is set to "1" as described hereinabove in connection with step S1. Accordingly, the sequence advances to step S83.

At step S83, a correction coefficient Kpbf depending upon the intake air pipe internal negative pressure Pb, hereinafter referred to as Pbf, on the F bank side or another correction coefficient depending upon the internal pressure Pi, hereinafter referred to as Pif, on the F bank side is calculated in a similar manner as at step S81 described hereinabove.

At step S84, Xrbank is set to "0", and the sequence returns to step S82 again. Then at step S85, Xrbank is set to "1" again, whereafter the sequence comes to an end.

Referring back to FIG. 8, at step S9, the fuel injection amount Ti stored at step S5 described hereinabove or a fuel injection amount Ti stored at step S7 hereinafter described is corrected for reduction and stored into a predetermined register.

$$Toutr = Kpir \times Kpbr \times Ti \quad (2)$$

$$Toutf = Kpif \times Kpbf \times Ti \quad (3)$$

Here, Toutr and Toutf are corrected fuel injection amounts for the R bank and the F bank, respectively. It is to be noted that, in case numerical values of Kpir, Kpbr, Kpif and Kpbf are not calculated at steps S81 to S83 of FIG. 12, the values are considered to be equal to 1. After completion of the process at step S9, the sequence returns to step S3.

In the case where it is judged at step S3 that Xcrng is equal to "0", it is judged that cranking has been completed, and at step S6, a fuel injection amount Ti for a warming up or a normal condition is retrieved from a map wherein, for example, the engine rotational speed Ne and the throttle opening Θth are used as parameters.

At step S7, the fuel injection amount Ti retrieved at step S6 is stored into the predetermined register similarly as at step S5. Then, the sequence advances to step S8.

It is to be noted that, at steps S4 and/or S6 described above, fuel injection amounts Ti for the R bank side and the F bank side may be retrieved individually from the fuel injection amount tables or maps provided individually therefor.

Figure 18A:
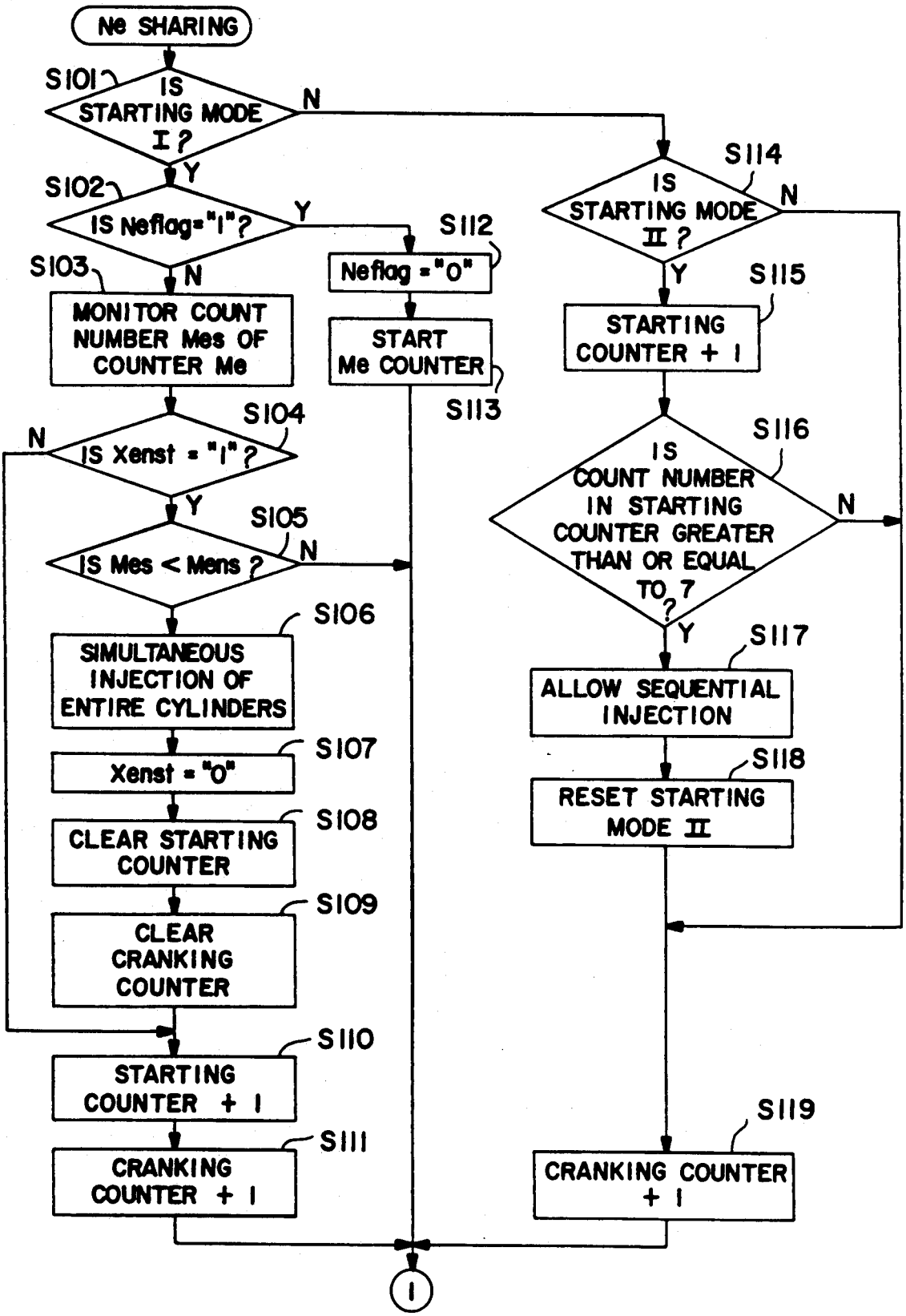
FIGS. 18A and 18B are flow charts showing an Ne pulse interrupt routine of operation of the embodiment of the present invention.
Figure 18B:
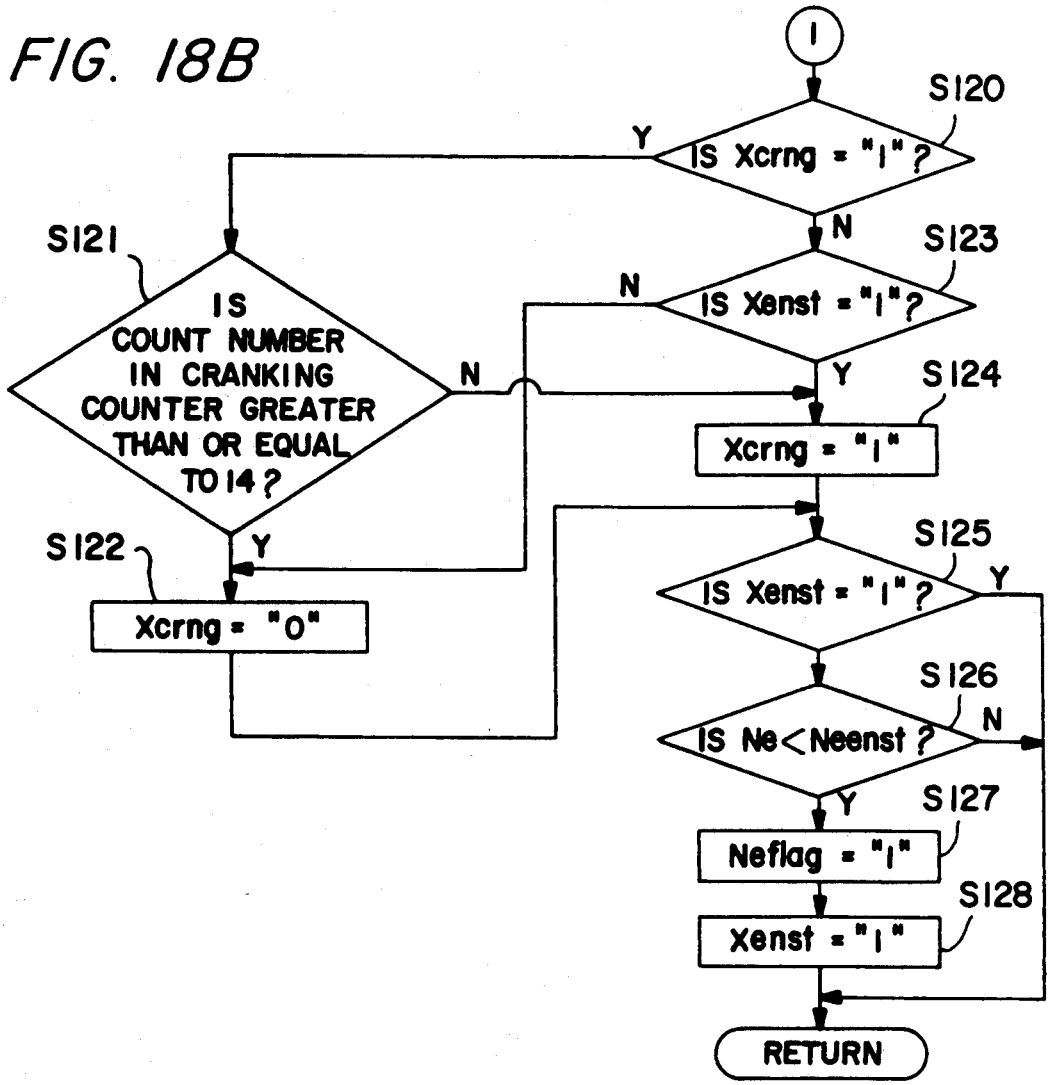

An interrupt routine for simultaneous injection by an Ne pulse will be described hereinafter. FIGS. 18A and 18B are flow charts showing an Ne pulse interrupt routine for the operation of the embodiment of the present invention. FIG. 19 is a time chart illustrating an exemplary operation of the embodiment of the present invention. It is assumed that, in FIG. 19, for a predetermined period of time after closing of a power source for the ECU, electronic controlling device of FIG. 2, that is, closing of an ignition switch, the CPU of the microcomputer provided in the inside of the ECU is initialized, and various processes are executed from a point of time denoted at the reference character I.

At first, description will be provided for an example wherein the Ne pulse interrupt routine is executed in response to an Ne pulse, an Ne pulse denoted by (1) in FIG. 19, which is developed for the first time after completion of the initial routine shown in FIG. 9.

At step S101, it is judged whether or not the current mode is a starting mode I. When the ignition switch is turned on, the mode is set to the starting mode I, and the mode is canceled and another starting mode II is entered when Xenst is changed to "0" at step S107 which will be hereinafter described and then a CYL pulse is received. Further, even if the engine is in the starting mode II or any other mode, when Xenst is set to "1", the mode is changed to the starting mode I again.

Since the mode is the starting mode I upon initialization, it is judged at step S102 whether or not Neflag is equal to "1". In the case where Neflag is equal to "1", Neflag is set to "0"at step S112, and then, if the engine rotational speed Ne becomes lower than the predetermined rotational speed after such setting to "0", then Neflag is set to "1" again at step S127 which will be hereinafter described. Accordingly, it can be said that the process at step S102 is a process for judging whether or not an Ne pulse is developed for the first time after closing of an ignition switch or after judgment of an engine stop.

Since Neflag is set to "1" in an initial condition, the sequence advances to step S113 by way of the step S112. At step S113, an Me counter is initiated to proceed with a measurement. The count value Mes of the Me counter is a reciprocal number to the engine rotational speed.

At step S120, it is judged whether or not Xcrng is equal to "1". Since Xcrng is set to "1" in the initial condition, it is judged subsequently at step S121 whether or not the count value of a cranking counter is equal to or greater than 14. The cranking counter is incremented at step S111 or S119 which will be hereinafter described and is provided to keep Xcrng in a set condition to "1" until a predetermined number (14) of Ne pulses are developed. In other words, the cranking counter is provided in order to allow a starting amount increase to be executed only for a period of time of a predetermined number of Ne pulses, and in the present embodiment, the number is set to 14.

Further, the Xcrng indicates, when it is equal to "1", that the vehicle is in a cranking, after starting, condition, but indicates, when it is equal to "0" that the vehicle is not in a cranking condition.

In the case where the count value described above is equal to or greater than 14, Xcrng is set to "0" at step S122, but in case where the count value is smaller than 14, Xcrng is set to "1" at step S124.

Subsequently, it is judged at step S125 whether or not Xenst is equal to "1". Since the Xenst is set to "1" upon initialization, the routine comes to an end.

The following will provide a description of an example wherein an Ne pulse denoted at (2) in FIG. 19 is developed. At first at step S101, the starting mode I is judged. Since Neflag is set to "0" at step S112 described above, the sequence advances from step S102 to step S103.

At step S103, the count value Mes of the Me counter which has started its measurement at step S113 described above is monitored and recorded.

At step S104, it is judged whether or not Xenst is equal to "1". Since Xenst is not yet reset, it is judged subsequently at step S105 whether or not the count value Mes is smaller than a predetermined value Mens, that is, whether or not the engine rotational speed Ne is higher than a predetermined rotational speed Nens, for example, 200 rpm. Here, it is assumed that the engine rotational speed Ne does not yet exceed the predetermined rotational speed Nens. Thereafter, the sequence advances to step S125 by way of Steps S120, S121 and S124.

Since Xenst still remains equal to "1", the sequence comes to an end subsequently to step S125.

The following description will be provided for an example wherein an Ne pulse denoted at (3) in FIG. 19 is developed. The sequence advances to step S105 by way of steps S101, S102, S103 and S104.

If it is assumed that the engine rotational speed Ne is higher than the predetermined rotational speed Nens at this point in time, that is, in the case where the engine rotational speed Ne exceeds the predetermined rotational speed Nens as a result of a kicking operation of a driver of the vehicle, simultaneous injection takes place in all of the cylinders at step S106. In particular, simultaneous injection takes place with the simultaneous injection amount Toutst calculated at step S25 of FIG. 9, see also FIG. 19.

Then at step S107, Xenst is reset to "0", refer to FIG. 19, and at steps S108 and S109, a starting counter and the cranking counter are reset to 0. The starting counter is provided to define a crank angle, Ne pulse number, until allowance of sequential injection of the individual cylinders, individual injection for each cylinder, after the simultaneous injection at step S106.

At steps S110 and S111, the starting counter and the cranking counter are incremented. In this instance, starting by the starting counter and the cranking counter is initiated as illustrated in FIG. 19. Thereafter, the sequence advances to step S125 by way of steps S120, S121 and S124. Since Xenst is set to step "0" at step S107 described hereinabove, the sequence subsequently advances to step S126.

At step S126, it is judged whether or not the engine rotational speed Ne is equal to a predetermined rotational speed Neenst, for example, 200 rpm. For the engine rotational speed Ne, the value monitored at step S103 described hereinabove or a value of the engine rotational speed Ne detected at a predetermined stage not shown may be employed.

If the engine rotational speed Ne is equal to or higher than the predetermined rotational speed Neenst, then the sequence comes to an end. However, if the engine rotational speed Ne is lower than the predetermined rotational speed Neenst, then Neflag and Xenst are set to "1" again at steps S127 and S128. In short, directly after execution of simultaneous injection, Neflag and Xenst have been reset at steps S112 and S107, respectively, and it is judged that the engine stop condition has been canceled, but if the engine rotational speed Ne is lower than the predetermined rotational speed Neenst, then it is judged that the engine is in an engine stop condition again. In FIG. 19, the engine rotational speed Ne is shown wherein Ne continues to be equal to or higher than the predetermined rotational speed Neenst.

In the case where an Ne pulse denoted at (4) in FIG. 19 is developed, the sequence advances to step S104 by way of Steps S101, S102 and S103. Since Xenst has been set to "0" at step S107, the sequence advances from step S104 to step S110. Thereafter, the sequence advances in a similar manner as described hereinabove.

The following description will be given for an example wherein an Ne pulse denoted at (5) in FIG. 19 is developed.

In the present example, a CYL pulse is developed immediately after the Ne pulse denoted at (5) has been developed. When Xenst is equal to "0" and a CYL pulse is received, the mode is changed over to the starting mode II as described hereinabove, refer to FIG. 19. Further, the stage counter for setting a stage number sets a stage number each time an Ne pulse is developed after a CYL pulse has been developed.

After the stating mode II is entered, the sequence advances from step S101 to step S115 by way of step S114.

At step S115, the starting counter is incremented, and then at step S116, it is judged whether or not the count value of the starting counter is equal to or greater than 7. Since the count value is still equal to 3 as illustrated in FIG. 19, the sequence advances to step S119 at which the cranking counter is incremented. Thereafter, the sequence successively advances to steps S120, S121, S124, S135 and S126.

If it is judged at step S126 that the engine rotational speed Ne is equal to or higher than the predetermined rotational speed Neenst, then the sequence comes to an end.

The following description is directed to the example wherein an Ne pulse denoted at (6) in FIG. 19 is developed. In the present example, incrementing of the count value of the starting counter is continued and the count value is set to 6 until a point in time directly before the Ne pulse denoted at (6) is developed.

The sequence advances to step S116 by way of steps S101, S114 and S115. Since the count value of the starting counter is set to 7 at step S115 described above, the sequence advances to step S117 subsequently to step S116.

At step S117, sequential injection of the individual cylinders is permitted. In other words, the injection mode changes from simultaneous injection to sequential injection of the individual cylinders. After a sequential injection allowed condition is entered, injection is controlled for the individual cylinders by the main injectors or the sub-injectors disposed for the individual cylinders in accordance with another flow chart, interrupt routine by an Ne pulse, not shown. The present example is constituted such that sequential injection is carried out at the third stage on the F bank side and at the fifth stage on the R bank side, that is, at an angular interval of 90 degrees.

It is to be noted that ignition takes place at an ignition timing which is read out or calculated in some other process not shown. Further, when the fuel injection amount is small, the sub injectors which are smaller in fuel injection amount per unit energization time are selected, but when the fuel injection amount is large, the main injectors which are greater in fuel injection amount per unit energization time are selected.

Further, since Xcrng is equal to "1" then, sequential injection is executed with a fuel injection amount Ti retrieved at step S4 and corrected at step S9 of FIG. 8.

At step S118, the starting mode II is canceled. In other words, the engine is put into a condition which is neither the starting mode I nor the starting mode II. Thereafter, the sequence advances to step S126 by way of steps S119, S120, S121, S124 and S125.

If it is determined at step S126 that the engine rotational speed Ne is equal to or higher than the predetermined rotational speed Neenst, then the sequence comes to an end.

The following description is directed to the example wherein an Ne pulse denoted at (7) in FIG. 19. In the present example, incrementing of the cranking counter at step S119 is continued till a point in time directly before the Ne pulse denoted at (7) is developed, and the count value is set to 13.

Since, in this instance, the engine is in a condition which is neither the starting mode I nor the starting mode II, the sequential advance to step S119 occurs by way of the steps of S101 to S114, and the cranking counter is incremented. Thereafter, the sequence advances from step Sl20 to S121.

At step S121, it is determined whether or not the count value of the cranking counter is equal to or greater than 14. However, since the cranking counter is set to 14 in the process at step S119 executed immediately before step S121, refer to FIG. 19, the sequence thereafter advances to step S122. At step S122, Xcrng is set to "0". In other words, it is determined that the cranking condition has come to an end.

In this instance, as Xcrng is set to "0", sequential injection is executed with a fuel injection amount Ti retrieved at step S6 and corrected at step S9 of FIG. 8.

Now, since Xcrng is set to "0" at step S122 described above, the sequential advance thereafter occurs from the process of step Sl20 to step S123 when the routine is executed.

At step S123, it is judged whether or not Xenst is equal to "1". Since Xenst is set to "0" at step S107 after execution of simultaneous injection, the sequence advances to step S122 after the process of step S123.

By the way, although it is determined at step S105 that the engine rotational speed Ne is higher than the predetermined rotational speed Nens and simultaneous injection is executed whereafter Xenst is set to "0" at Step S107 as described hereinabove, if it is thereafter determined at step S126 that the engine rotational speed Ne is equal to or lower than Neenst, Neflag is set to "1" again at step S127. Simultaneously, Xenst is also set to "1" again at step S128.

Accordingly, even after simultaneous injection is performed, if the engine rotational speed Ne drops, then the processing mode becomes the starting mode I again in this manner, and the interrupt process shown at step S27 in FIG. 9 is executed again.

Accordingly, in the process of the routine executed thereafter by an Ne pulse interruption, the sequence advances from the process of step S101 successively to the processes of steps S102, S112, ... and S102 and S1O3, ... so that simultaneous injection will be executed again.

It is to be noted that, in this instance, which Xcrng is set to "1" at step S124, it may be set to "1" otherwise after the process of step S127.

Figure 20:
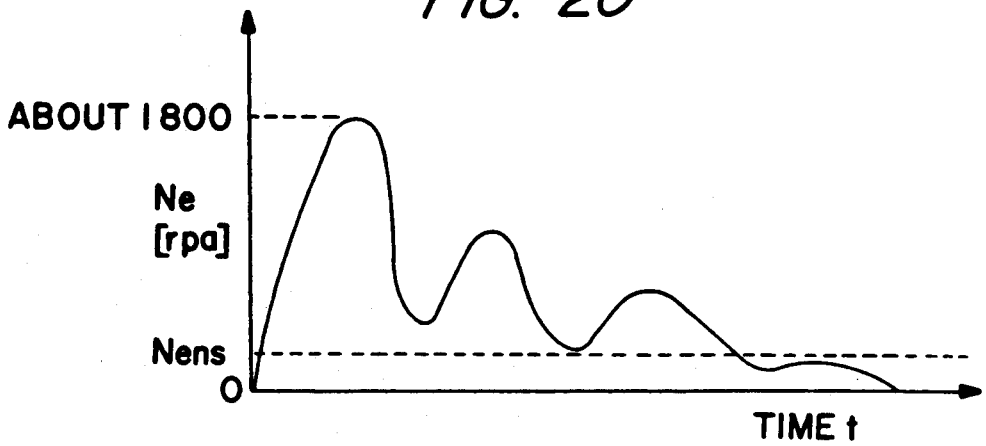
FIG. 20 is a graph showing a manner of variation of a rotational speed of an engine when the engine is started using a kick starter device wherein firing does not take place successfully.
Figure 23:
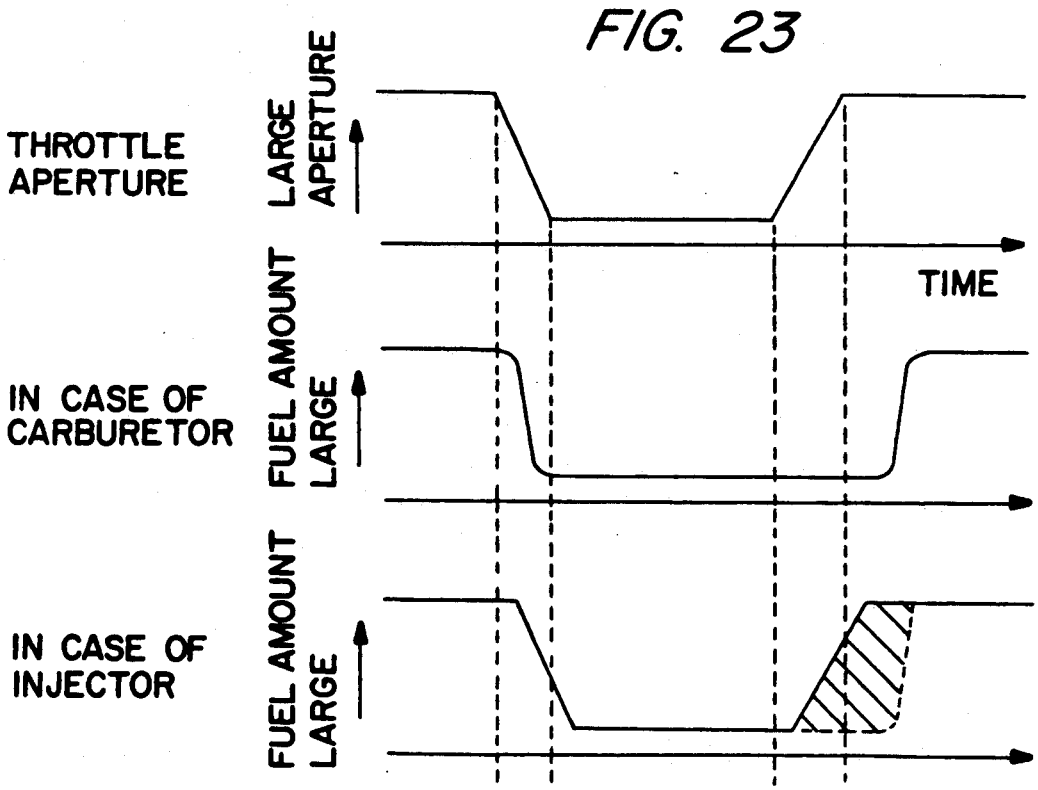
FIG. 23 is a view illustrating a variation in throttle opening in a two-cycle engine and a variation in amount of fuel to be supplied in response to such variation in throttle opening.

FIG. 20 is a graph showing a manner of variation of the engine rotational speed when starting of the engine is performed using the kick starting device but firing does not successfully take place. It is to be noted that Xenst is set to "1" when the engine rotational speed Ne is higher than the predetermined rotational speed Nens as described hereinabove in connection with step S105 in FIG. 18.

Even if the idling rotational speed of the engine is 1,200 rpm or so, when the engine is started using the kick starter device, the engine rotational speed Ne instantaneously reaches 1,800 rpm or so as shown in FIG. 20. Accordingly, while it is not possible to make a judgment of starting of the engine using a rotational speed around an idling rotational speed simply as a threshold value, if various flags are set to determine an engine condition as described above, it becomes possible to make a determination of starting even with an engine which employs a kick starter device.

Figure 21:
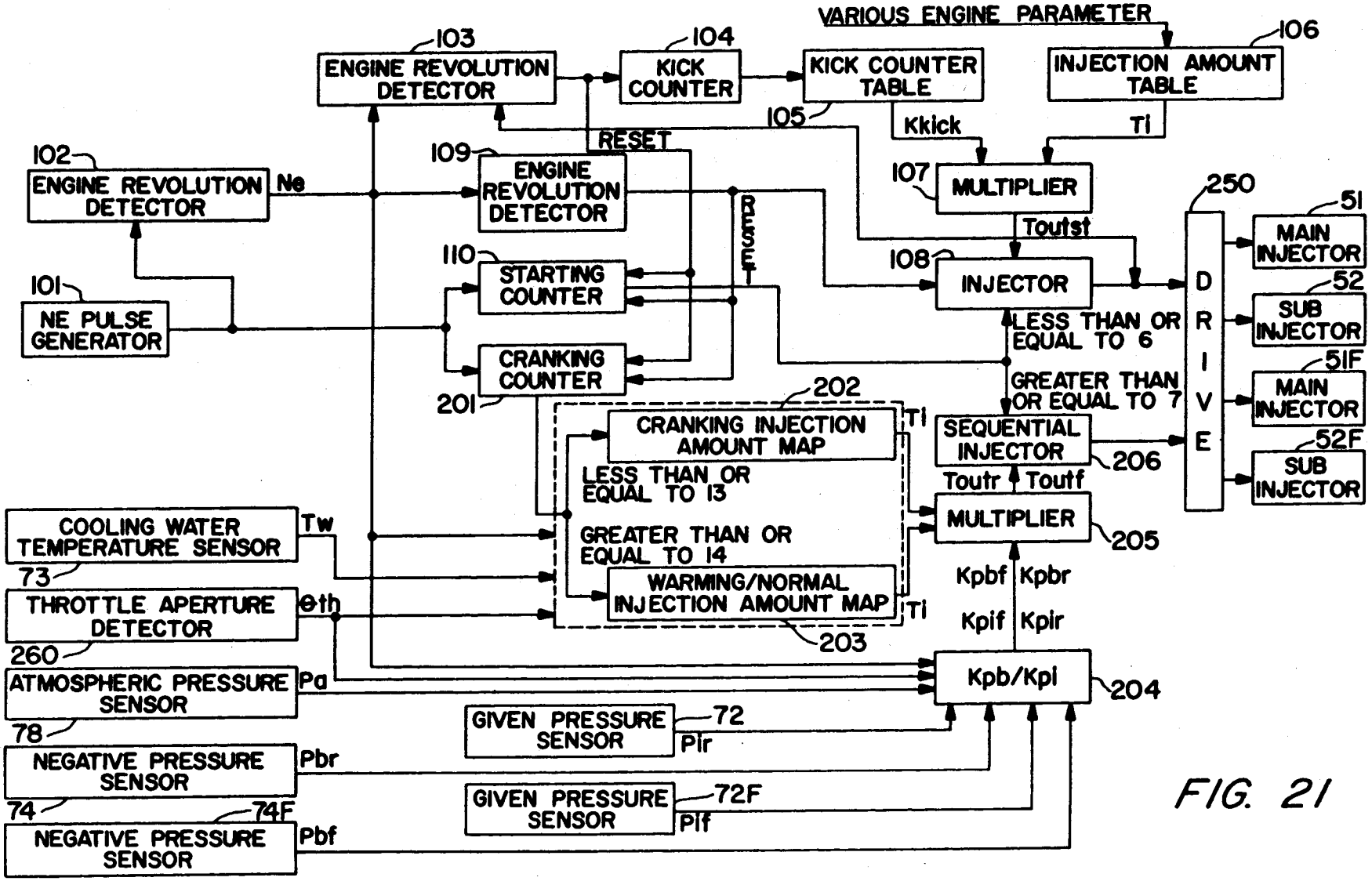
FIG. 21 is a functional block diagram of the embodiment of the present invention.

FIG. 21 is a functional block diagram of the embodiment of the present invention. In FIG. 21, like reference characters to those of FIG. 2 denote like or corresponding portions.

Referring to FIG. 21, an engine rotational speed detecting means 102 detects an engine rotational speed Ne using Ne pulses developed from an Ne pulse generating means 101.

When Ne exceeds the predetermined rotational speed Nens, refer to step S105, an engine rotational speed judging means 109 excites a simultaneous injecting means 108 and at the same time excites a starting counter 110 and a cranking counter 201 to reset the counters, whereafter it causes the counters to start their counting operations.

When the count value of the starting counter 110 is equal to or smaller than 6, the simultaneous injecting means 108 excites a driving means 250 using data developed from a multiplying means 107 which will be hereinafter described to operate the main injectors 51 or the sub injectors 52 on the R bank IR side and the main injectors 5lF or the sub-injectors 52F on the F band 1F side.

After closing of the ignition switch, the count value of the kick counter 104 is set to 1, and when it is judged by an engine rotational speed judging means 103 that Ne is lower than the predetermined rotational speed Neenst, refer to step S126, after execution of simultaneous injection by the simultaneous injecting means 108, the count value of a kick counter 104 is incremented. Further, the count values of the starting counter 110 and the cranking counter 201 are then reset, whereafter counting is started again.

A correction coefficient Kkick corresponding to the count value of the kick counter I04 is read out from a kick counter table I05. Meanwhile, a simultaneous fuel injection amount Ti is read out in response to various engine parameters from a simultaneous fuel injection amount table 106.

The multiplying means 107 multiplies the simultaneous fuel injection amount Ti by the correction coefficient Kkick to calculate a fuel injection amount Toutst.

The starting counter 110 and the cranking counter 201 count Ne pulses developed from the Ne pulse generating means 101. In an example where the count value of the starting counter 110 is equal to or smaller than 6, the simultaneous injecting means 108 is excited. However, in an example where the count value of the starting counter 110 is equal to or greater than 7, a sequential injecting means 206 is energized. The sequential injecting means 206 controls the driving means 250 using data developed from another multiplying means 205 which will be hereinafter described.

In an example where the count value of the cranking counter 201 is equal to or smaller than 13, a cranking injection amount map 202 is selected, but in case the count value is equal to or greater than 14, a warming up/normal injection amount map 203 is selected.

Such a cranking table as shown in FIG. 11 is stored in the cranking injection amount map 202, and a fuel injection amount Ti for cranking corresponding to a cooling water temperature Tw developed from the cooling water temperature sensor 73 is read out from the cranking injection amount map 202. Meanwhile, a fuel injection amount map is stored in accordance with an engine rotational speed Ne and a throttle opening Θth for those parameters and a cooling water temperature Tw in the warming up/normal injection amount map 203, and a fuel injection amount Ti for warming up or after completion of warming up is read out from the warming up/normal injection amount map 203 in response to a throttle opening Θth and Tw developed from an Ne and throttle opening detecting means 260, corresponding to the potentiometer 59 of FIG. 2.

Figure 1:
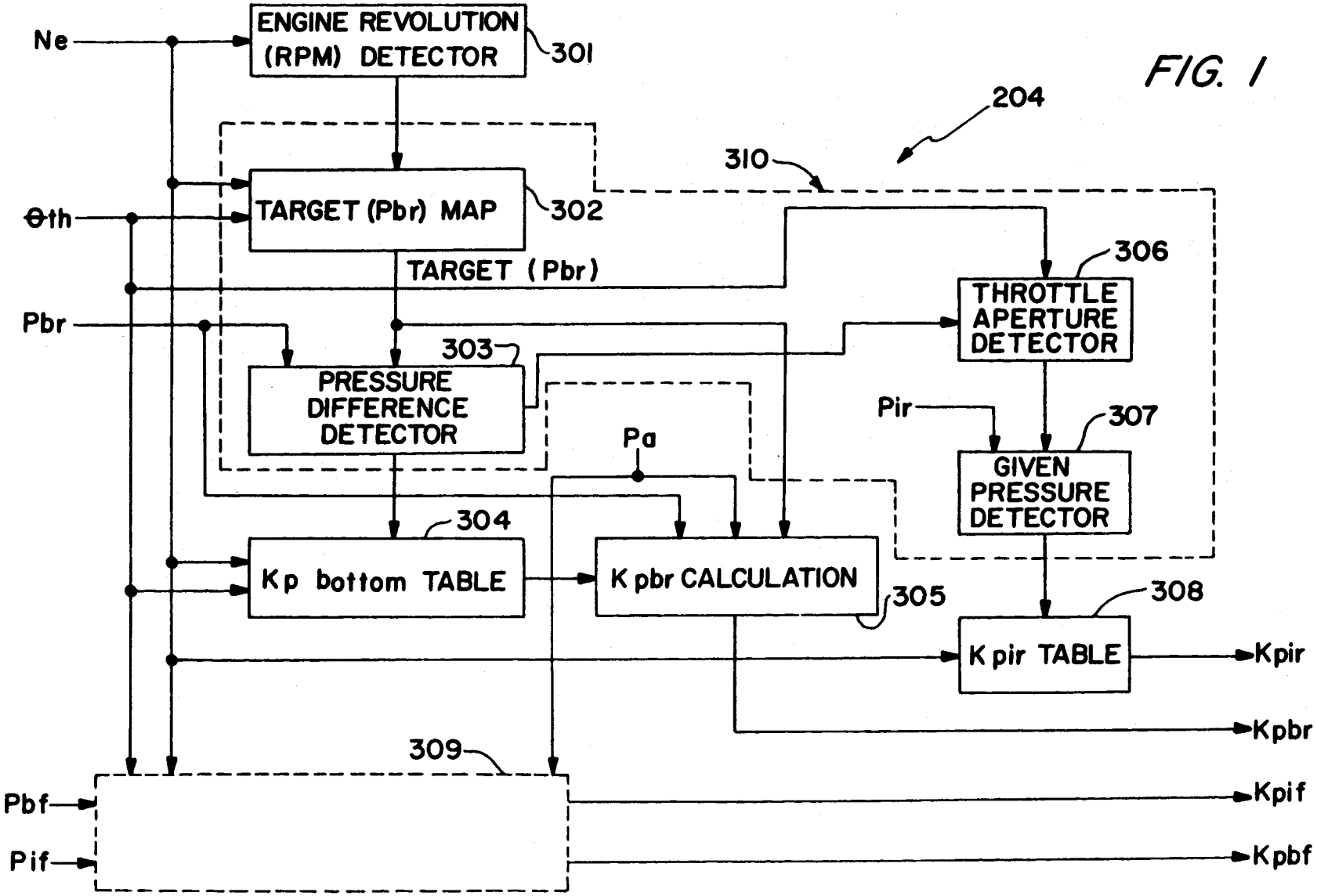
FIG. 1 is a functional block diagram showing construction of a Kpb/Kpi calculating means of FIG. 21.

A Kpb/Kpi calculating means 204 has such a construction as shown in FIG. 1 and calculates correction coefficients Kpbr or Kpir and Kpbf or Kpif using Ne, Θth, an atmospheric pressure Pa developed from the atmospheric pressure sensor 78 as well as an internal pressure Pir and an intake air pipe internal negative pressure Pbr developed from the internal pressure sensor 72 provided on the R bank IR side and the intake air pipe internal negative pressure sensor 74, and an internal pressure Pif and an intake air pipe internal negative pressure Pbf developed from the internal pressure sensor 72F provided on the F bank IF side and the intake air pipe internal negative pressure sensor 74F. The thus calculated correction coefficients are delivered to the multiplying means 205.

The multiplying means 205 executes calculations given by the second and third expressions.

FIG. 1 is a functional block diagram showing construction of the Kpb/Kpi calculating means 204.

Referring to FIG. 1, an engine rotational speed judging means 301 retrieves a target Pbr map 302 and reads out a target Pbr in response to Ne and Θth when the engine rotational speed Ne is equal to or higher than a predetermined rotational speed, a reciprocal number to Mekpbcalc shown at step S811 of FIG. 13.

A pressure difference judging means 303 excites a Kpb bottom table 304, refer to FIG. 14, and reads out Kpb bottom in response to Ne and Θth from the Kpb bottom table 304 when the difference of the target Pbr subtracted from an actual intake air pipe internal negative pressure Pbr on the R bank side is higher than a predetermined pressure.

A Kpbr calculating means 305 calculates a correction coefficient Kpbr for the R bank side using the thus read out Kpb bottom as well as the target Pbr, atmospheric pressure Pa and actual intake air pipe internal negative pressure Pbr. The calculation is executed by the technique shown at step S816 in FIG. 13.

In case it is judged by the pressure difference judging means 303 that the difference of the target Pbr subtracted from the actual intake air pipe internal negative pressure Pbr is not higher than the predetermined pressure, a throttle opening judging means 306 is excited. If the throttle opening judging means 306 determines that the throttle opening Θth is equal to or greater than a predetermined opening, refer to step S817 of FIG. 13, then an internal pressure judging means 307 is excited.

The internal pressure judging means 307 reads out a correction coefficient Kpir for the R bank side in response to Ne from a Kpir table 308, refer to FIG. 17, when the actual internal pressure Pir on the R bank side is equal to or lower than a predetermined pressure, refer to step S8181 of FIG. 16.

The map 302 and the means 303, 306 and 307 constitute a misfire detecting means 310 for detecting a misfire condition of the R bank.

It is to be noted that the reason why the target Pbr map 302 is retrieved when it is judged by the engine rotational speed judging means 301 that the engine rotational speed Ne is equal to or higher than the predetermined rotational speed, that is, the reason why a judgment of a misfire is made, is such as follows.

In particular, since a muffler and so forth in a motorbicycle or the like on which a two-cycle engine is mounted are set so that generally the delivery ratio may be high at a high rotational speed of the engine to obtain a high output power, in case a misfire takes place in such high engine rotational speed condition, the delivery ratio drops remarkably compared with a situation wherein firing takes place. Accordingly, when the engine rotational speed is high, if the throttle opening is increased after a misfire has taken place with a low throttle opening, the fuel air mixture likely becomes overrich. On the contrary, at a low engine rotational speed, the delivery ratio when a misfire takes place is not different very much from a delivery ratio when firing takes place.

Accordingly, only when the engine rotational speed is high, the target Pbr map 302 is retrieved to make a judgment of a misfire using the internal pressure sensor. Then, in the situation where a misfire is judged, the fuel amount is decreased.

It is a matter of course that the judging means 301 may be omitted so that a determination of a misfire may be accomplished at any engine rotational speed Ne. Meanwhile, where the muffler and so forth are set so that the delivery ratio may be increased to obtain a high output power at a low engine rotational speed, a judgment of a misfire may be made when the engine rotational speed Ne is equal to or lower than a predetermined rotational speed.

Referring to FIG. 1, member 309 is composed of components similar to the means 301 to 308 described hereinabove and sets correction coefficients Kpbf and Kpif for the F bank side using received Ne, Θth, Pa, an actual intake air pipe internal negative pressure Pbf of the F bank side and an actual internal pressure Pif of the F bank side. Since construction of the member 309 can be recognized readily from the foregoing description, further information relating thereto is omitted.

It is to be noted that such various means included in the member 309 may be the same as the means 301 to 308 or else the means 301 to 308 wherein the various tables, maps or various threshold values involved are changed or modified. In other words, for calculation of the correction coefficients Kpbf and Kpif for the F bank side, the same tables, maps or threshold values as the various tables, maps or the various threshold values which are used for calculation of the correction coefficients Kpbr and Kpir for the R bank side may be used, or else different tables, maps or threshold values may be used.

Now, while the main injectors 51 and the subinjectors 52 provided for the intake air pipes mounted on the individual cylinders are mounted in an asymmetrical relationship with respect to the center line of the intake air pipes as shown in detail in FIG. 5, they may be mounted otherwise in a symmetrical relationship with respect to the center line as shown in FIG. 22. Further, more than three injectors or only one injector may be provided for an intake air pipe mounted on each cylinder.

Further, while the present invention is described as applied to a V-type engine, it is a matter of course that the present invention may be applied to a single cylinder engine or else to a straight or horizontal opposed type engine or the like.

As is apparent from the foregoing description, according to the present invention, the following results are attained. In particular, since the fuel injection amount is decreased upon transition from a misfire condition to a fired condition, even if fuel determined in response to a throttle opening Θth is injected immediately, the air fuel ratio will not at all become overrich. Accordingly, transition from a misfire condition to a fired condition can be achieved smoothly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A fuel injection control apparatus for a two-cycle engine including an electronic type fuel injection apparatus comprising:

a kick starter for actuating the electronic type fuel injection apparatus;

counter means for counting the number of times the kick starter is actuated; and means for sequentially reducing fuel injection to the two-cycle engine with every increase in a count value representing an increase in the counting of the number of times the kick starter is actuated for enhancing the possibility of firing of the two-cycle engine.

2. The fuel injection control apparatus according to claim 1, wherein a fuel injection quantity decreases with an increase in the warming up temperature of the two-cycle engine.

3. The fuel injection control apparatus according to claim 2, and further including water cooling for said two-cycle engine and said fuel injection quantity decreases with an increase in the water temperature.

4. The fuel injection control apparatus according to claim 1, and further including resetting means for resetting the counter means to zero after the kick starter is not actuated for a predetermined time period.

* * * * *